US011548290B2

(12) United States Patent
Venkataramanan et al.

(10) Patent No.: US 11,548,290 B2
(45) Date of Patent: Jan. 10, 2023

(54) SYSTEMS AND TECHNIQUES FOR MELTING HOT MELT INK IN INDUSTRIAL PRINTING SYSTEMS

(71) Applicant: Markem-Imaje Corporation, Keene, NH (US)

(72) Inventors: Arjun Venkataramanan, Keene, NH (US); Alan G. Gibson, Antrim, NH (US); Bernard Marcel Bunner, Newton, MA (US); Frances H. Benton, Keene, NH (US)

(73) Assignee: Markem-Imaje Corporation, Keene, NH (US)

( * ) Notice: Subject to any disclaimer, the term of this patent is extended or adjusted under 35 U.S.C. 154(b) by 0 days.

(21) Appl. No.: 17/376,074

(22) Filed: Jul. 14, 2021

(65) Prior Publication Data

US 2022/0063287 A1 Mar. 3, 2022

Related U.S. Application Data

(60) Provisional application No. 63/071,847, filed on Aug. 28, 2020.

(51) Int. Cl.
*B41J 2/175* (2006.01)

(52) U.S. Cl.
CPC ..... *B41J 2/17593* (2013.01); *B41J 2/17566* (2013.01); *B41J 2002/17576* (2013.01)

(58) Field of Classification Search
CPC ..... B41J 2/17593; B41J 2/17566; B41J 2002/17576
See application file for complete search history.

(56) References Cited

U.S. PATENT DOCUMENTS 5,489,925 A 2/1996 Brooks et al.
5,920,332 A 7/1999 Brooks
(Continued)

FOREIGN PATENT DOCUMENTS

JP H0632037 U * 4/1994
WO WO-2010077386 A1 * 7/2010 ..... B41J 2/175
WO WO2010077386 A1 7/2010

OTHER PUBLICATIONS

European Patent Application No. 21192307.3, Extended European Search Report, dated Jan. 18, 2022, 7 pages.
(Continued)

*Primary Examiner* — Sharon Polk
(74) *Attorney, Agent, or Firm* — Fish & Richardson P.C.

(57) ABSTRACT

Industrial printing systems, including systems and techniques relating to drop-on-demand (DOD) inkjet printing systems include an apparatus including: a receptacle defining a hold chamber to receive ink, the receptacle including a first portion configured to hold a first quantity of ink, and a second portion that is smaller than the first portion and configured to hold a second quantity of ink, the second portion including a first heat conducting surface, and a second heat conducting surface offset from the first heat conducting surface by a distance determined in accordance with a melting point of the ink, the second heat conducting surface defining a barrier between the first portion and the second portion and including at least one opening configured to allow flow of the ink from the first portion to the second portion; and at least one heating element configured to heat the receptacle.

20 Claims, 20 Drawing Sheets

(56) References Cited

U.S. PATENT DOCUMENTS

| | | | |
|---|---|---|---|
| 6,276,790 | B1 | 8/2001 | Ikezaki |
| 7,018,017 | B2 | 3/2006 | Song et al. |
| 7,487,590 | B2 | 2/2009 | Song et al. |

OTHER PUBLICATIONS

Matthews Marking Systems Unveils Hot Melt Wax Ink Offering, OEM Magazine, Oct. 16, 2018, 8 pages.

* cited by examiner

SYSTEMS AND TECHNIQUES FOR MELTING HOT MELT INK IN INDUSTRIAL PRINTING SYSTEMS

CROSS-REFERENCE TO RELATED APPLICATION

This application claims priority under 35 U.S.C. § 119 to U.S. Application Ser. No. 63/071,847, filed on Aug. 28, 2020, and entitled "Systems and Techniques for Melting Hot Melt Ink in Industrial Printing Systems," the entire contents of which are incorporated by reference herein.

BACKGROUND

This specification relates to industrial printing systems, including systems and techniques relating to drop-on-demand (DOD) inkjet printing systems.

Various industrial printing technologies enable the printing of important information (e.g., sell by dates) on packaging. DOD inkjet printing systems can be used to print images on commercial products using various types of inks, including hot melt inks. These images can include graphics, company logos, alphanumeric codes, and identification codes, and so forth. For example, such images can be observed on the corrugated cardboard boxes containing consumer products.

Hot melt inks (sometimes referred to as phase change inks) can include modified waxes and are usually solid at ambient temperature and liquid at temperatures above ambient temperature. Hot melt inks can be used, for example, in digital printing methods. During printing, the ink is typically heated until it becomes a liquid, which is then ejected through a printhead onto a substrate. The ink can solidify on the substrate at ambient temperature. The hot melt ink can be used with DOD inkjet printers having heating capabilities, which can eject droplets of ink through tiny nozzles to form small dots, which in turn form an image on a substrate. Some DOD inkjet printing systems that use hot melt inks may require at least 60 minutes after startup to allow the system to reach its operating temperature for printing (for example, DOD inkjet printing systems that use a large "single stage" aluminum reservoir such as a 1.5 liter single stage reservoir).

SUMMARY

This specification describes technologies relating to industrial printing systems, and in particular, systems and techniques relating to drop-on-demand (DOD) inkjet printing systems. A DOD inkjet printing system can include a "hold chamber" including a "two-stage" receptacle configured to hold a first quantity of ink in a first portion and a second quantity of ink in a second portion, in which the second portion is smaller than the first portion (and therefore, the second quantity of ink is less than the first quantity). The "two-stage" receptacle can facilitate a "two-stage heating" technique that ensures the second quantity of ink in the second portion is completely molten after a shorter heating period when compared with the first quantity of ink in the first portion. Rapid melting can be facilitated by the geometry of the second portion, which can be sized to minimize the thermal mass of ink to be melted before printing can begin, and which can be designed to stimulate heat conduction from the surrounding walls.

In general, one or more aspects of the subject matter described in this specification can be embodied in one or more apparatus that include: a receptacle defining a hold chamber to receive ink, the receptacle including a first portion configured to hold a first quantity of ink, and a second portion that is smaller than the first portion and configured to hold a second quantity of ink, the second portion including a first heat conducting surface, and a second heat conducting surface offset from the first heat conducting surface by a distance determined in accordance with a melting point of the ink, the second heat conducting surface defining a barrier between the first portion and the second portion and including at least one opening configured to allow flow of the ink from the first portion to the second portion; and at least one heating element configured to heat the receptacle.

The at least one heating element can include a first heating element and a second heating element. The first heating element can have a first wattage rating and the second heating element can include a second wattage rating that is higher than the first wattage rating. The second at least one heating element can be located closer to the second portion than the first portion, and, when the heating element is heating the receptacle, the distance can be sized to reduce a thermal mass of the second quantity of ink, thereby causing all of the second quantity of ink to melt before the first quantity of ink.

The apparatus can include a pressure relief valve coupled to the receptacle and configured to actuate when a pressure of the receptacle exceeds a threshold pressure. The first portion can include a first chamber and the second portions can include a second chamber, and the barrier can include a baffle plate that separates the first chamber and the second chamber. The at least one opening can include a first opening located at a first end of the barrier and a second opening located at a second end of the barrier that is opposite of the first end. Moreover, the barrier can include a plate attached to a bottom surface of the receptacle.

One or more aspects of the subject matter described in this specification can also be embodied in one or more systems that include a first receptacle defining a melt chamber configured to receive a container of ink; a second receptacle in fluidic communication with the first receptacle and defining a hold chamber configured to receive the ink from the container; the second receptacle including: a first portion configured to hold a first quantity of the ink; and a second portion that is smaller than the first portion and configured to hold a second quantity of the ink, the second portion including: a first heat conducting surface; and a second heat conducting surface offset from the first heat conducting surface by a distance in accordance with a melting point of the ink, the second heat conducting surface defining a barrier between the first portion and the second portion and including at least one opening configured to allow flow of the ink from the first portion to the second portion; a first at least one heating element configured to heat the first receptacle; a second at least one heating element configured to heat the second receptacle; a print head including a plurality of nozzles and a third at least one heating element configured to heat the print head, the print head configured to eject melted ink through the plurality of nozzles; an ink supply system including an ink line configured to fluidly couple the print head with the hold chamber and a fourth at least one heating element configured to heat the ink line; and control circuitry configured to: cause the first at least one heating element to heat the first receptacle; cause the second at least one heating element to heat the second receptacle; cause the third at least one heating element to heat the print head; and cause the fourth at least one heating element to heat the ink line.

The system can include a sensor located within the first portion of the second receptacle, wherein the control circuitry is further configured to: determine, based on information captured by the sensor, a current quantity of ink being held in the second receptacle; and cause the first at least one heating element to heat the first receptacle when the current quantity of ink does not exceed a threshold quantity. The control circuitry can be further configured to: cause the third at least one heating element to heat the print head to a threshold temperature; cause the fourth at least one heating element to heat the ink line to the threshold temperature; and cause the second at least one heating element to heat the hold chamber to the threshold temperature.

The second at least one heating element can include: a primary heating element that includes a first wattage rating; and a secondary heating element that includes a second wattage rating being higher than the first wattage rating; and the startup procedure can include turning off the secondary heating element when the second receptacle is heated to the second threshold temperature. The startup procedure can include causing the third at least one heating element to heat the print head to the second threshold temperature. The system can include a pressure relief valve coupled to the second receptacle and configured to actuate when a pressure of the second receptacle exceeds a threshold pressure. The at least one opening can include a first opening located at a first end of the barrier and a second opening located at a second end of the barrier that is opposite of the first end. The second at least one heating element can be located closer to the second portion than the first portion and the distance is configured to cause all of the second quantity of ink to melt before the first quantity of ink, when the second at least one heating element is heating the second receptacle, by reducing a thermal mass of the second quantity of ink relative to the first quantity of ink.

One or more aspects of the subject matter described in this specification can also be embodied in one or more non-transitory computer-readable storage mediums encoding instructions that cause control circuitry of a printing system to perform operations including: regulating, using at least one heating element, an ink line of the printing system at a threshold temperature; regulating, using at least one heating element, a print head of the printing system at the threshold temperature; and causing the at least one heating element to heat a hold chamber of the printing system to a second threshold temperature.

The operations can include: determining, based on information captured by a sensor within a first portion of the hold chamber, a current quantity of ink being held in the hold chamber; and causing the at least one heating element to heat a melt chamber of the printing system when the current quantity of ink does not exceed a threshold quantity. The at least one heating element can include: a primary heating element that includes a first wattage rating; and a secondary heating element that includes a second wattage rating being higher than the first wattage rating; the primary heating element and the secondary heating element can be used to heat the hold chamber to the second threshold temperature; and the operations can include turning off the secondary heating element when the hold chamber is heated to the second threshold temperature. Moreover, the operations can include causing the at least one heating element to heat the print head to the second threshold temperature.

When compared with conventional technology, implementations of the present disclosure can provide one or more of the following advantages. A printing system can be configured to implement a staged heating technique at startup by using a reservoir (e.g., a 1.5 liter aluminum reservoir) having two ink holding portions, one portion being substantially smaller than the other portion. The time required for molten ink to become available for printing after a cold start up can be reduced. Costs associated with downtime caused by start-up times can be reduced. Potential damage to the printing system as a result of faster heating times can be reduced.

The details of one or more embodiments of the subject matter described in this specification are set forth in the accompanying drawings and the description below. Other features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

DOD inkjet printing systems can include ink delivery modules (IDMs) configured to supply the system's print heads with ink for printing. Hot melt inks typically include modified waxes. At room temperature, they are usually solid. When they are heated, they may transition first to a "mushy" phase (for example, a phase between a solid and liquid phase), in a broad temperature region around 50° C. and 90 C, then become liquid. Print heads and inks can be designed to jet at, for example, 125° C., 10-14 centipoise.

Implementations of the present disclosure can help overcome one or more disadvantages of conventional printing systems caused by, for instance, the implementation of a large "single stage" aluminum reservoir (for example, a 1.5 liter single stage reservoir), and the low thermal conductivity (for example, 0.1756-0.25 W/mK) of some hot melt inks. For example, implementations of the present disclosure can reduce the downtime caused by heating processes needed for reaching operational temperatures for printing, which can be costly (in terms of time and money) to the user. In some implementations, a printing system is configured to implement a staged heating technique to reduce the thermal mass of hot melt ink by using a reservoir (e.g., a 1.5 liter aluminum reservoir) having two ink holding portions, one portion being substantially smaller than the other portion. In some implementations, this reduction in thermal mass allows the heat from the aluminum walls of the smaller portion to penetrate thermally insulating ink by heat conduction and raise its internal temperature at a much faster rate compared to the large portion, thus reducing the time for molten ink to become available for printing after a cold start up. Many hot melt inks expand and shrink during heating and cooling periods. The smaller portion prevents some hot melt inks from shrinking away from the aluminum walls during cooling period. This ensures that the solid hot melt ink during cold start up is always in contact with walls (e.g., aluminum walls) in the smaller portion stimulating heat conduction from surrounding walls.

Figure 1:
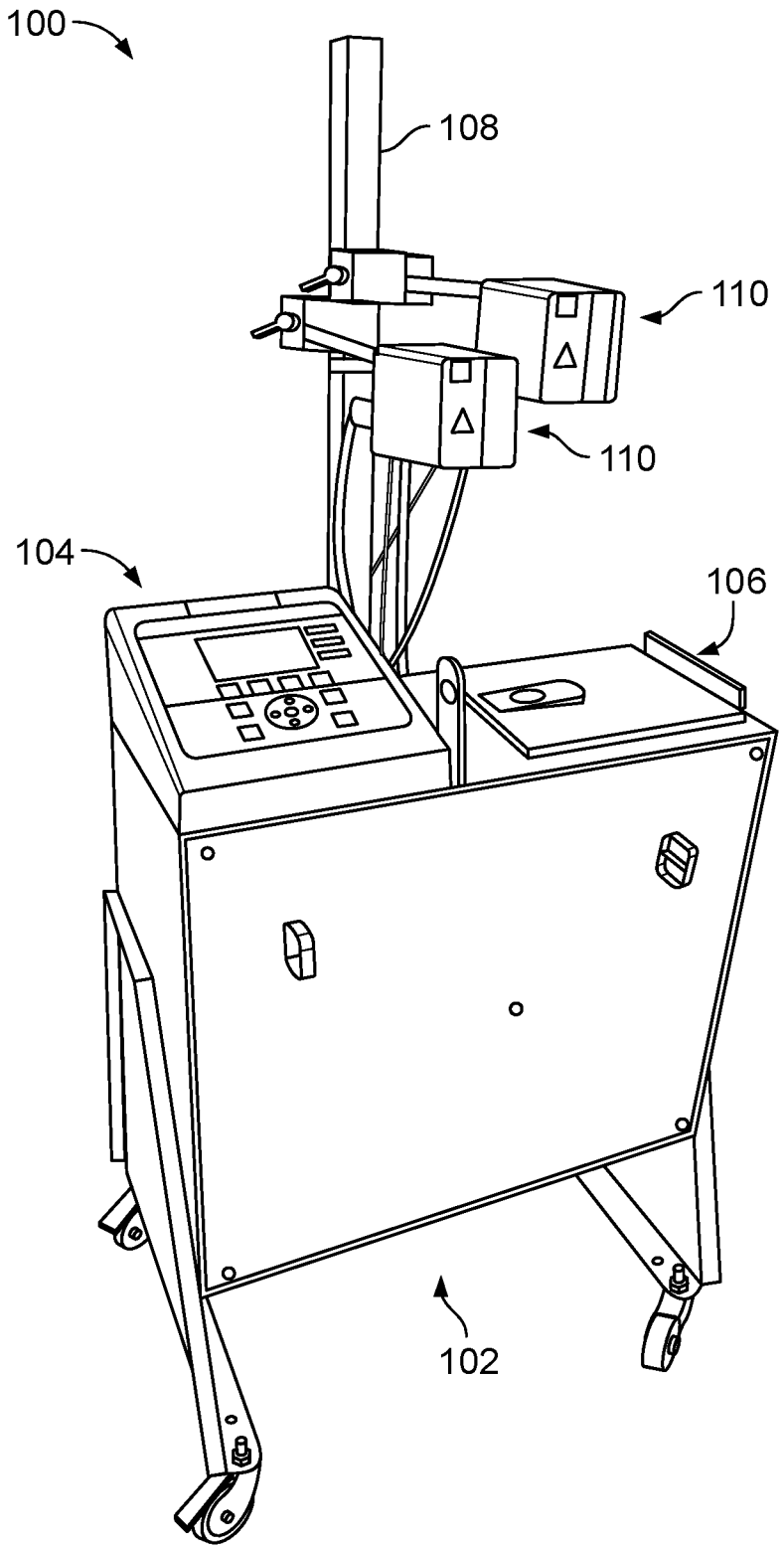
FIG. 1 shows an example of a printing system.

FIG. 1 shows an example of a printing system 100. The printing system 100 includes a cabinet 102 to house a controller device (which includes control circuity, for example, as discussed later with reference to FIGS. 9A-9B) having a user interface 104, and an (off head) ink reservoir (which can include an ink receptacle, such as one of the two stage ink-receptacles discussed in this specification with reference to FIGS. 3A-3B, 6, and 8A-8B) having a door 106 for access thereto. The printing system 100 also includes a print bar 108 configured to receive one, two, three, four, five or more print heads 110. The print head(s) 110 can be repositioned and/or reoriented on the print bar 108 with respect to one or more substrates, such that the print head(s) 110 eject ink (as directed by the controller device of the printing system 100) to print images on the substrate(s) as they move past the print head(s) 110. In some implementations, the print bar 108 is a print head stand on its own rollers, wheels or casters, allowing the print head stand 108 to be moved independently from the cabinet 102, which includes its own rollers, wheels or casters. As used herein, a "substrate" for printing is not necessarily a continuous substrate and can include discrete packages and products (e.g., that move past the print head(s) 110 on a conveyor belt in a production and/or packaging line).

The printed images can include alphabetical and/or numeric characters (e.g., date codes or text serial numbers), barcode information (e.g., 1D or 2D barcodes), graphics, logos, etc. The controller device (for example, as discussed later with reference to FIGS. 9A-9B) includes electronics (such as control circuitry), which can include one or more processors that execute instructions (e.g., stored in memory in the electronics) to control the operation of the printing system 100. Suitable processors include, but are not limited to, microprocessors, digital signal processors (DSP), microcontrollers, integrated circuits, application specific integrated circuits (ASICs), logic gate arrays and switching arrays. The electronics can also include one or more memories for storing instructions to be carried out by the one or more processors and/or for storing data developed during operation of the printing system 100. Suitable memories include, but are not limited to, Random Access Memory (RAM), Flash RAM, and electronic read-only memories (e.g., ROM, EPROM, or EEPROM).

The substrate(s) can be labels that are added to products, packaging material for products (either before or after the product(s) are placed in the packaging), and/or surface(s) of the products themselves. For example, the substrate can be corrugated cardboard boxes containing one or more products. Thus, the print head(s) 110 can be repositioned and/or reoriented on the print bar 108 with respect to one or more product lines, including conveyor belt(s) and/or other product movement mechanism(s), that move products through a facility. The facility can be a product manufacturing facility, a product distribution facility, and/or other industrial/business facilities/buildings, and the product line can include a product packaging system, a product sorting system, and/or other product handling/management systems. As will be appreciated, the printing system 100 is only one example, and many other suitable structures can be used to construct a printing system that employs the print head systems and techniques described herein.

Figure 2:
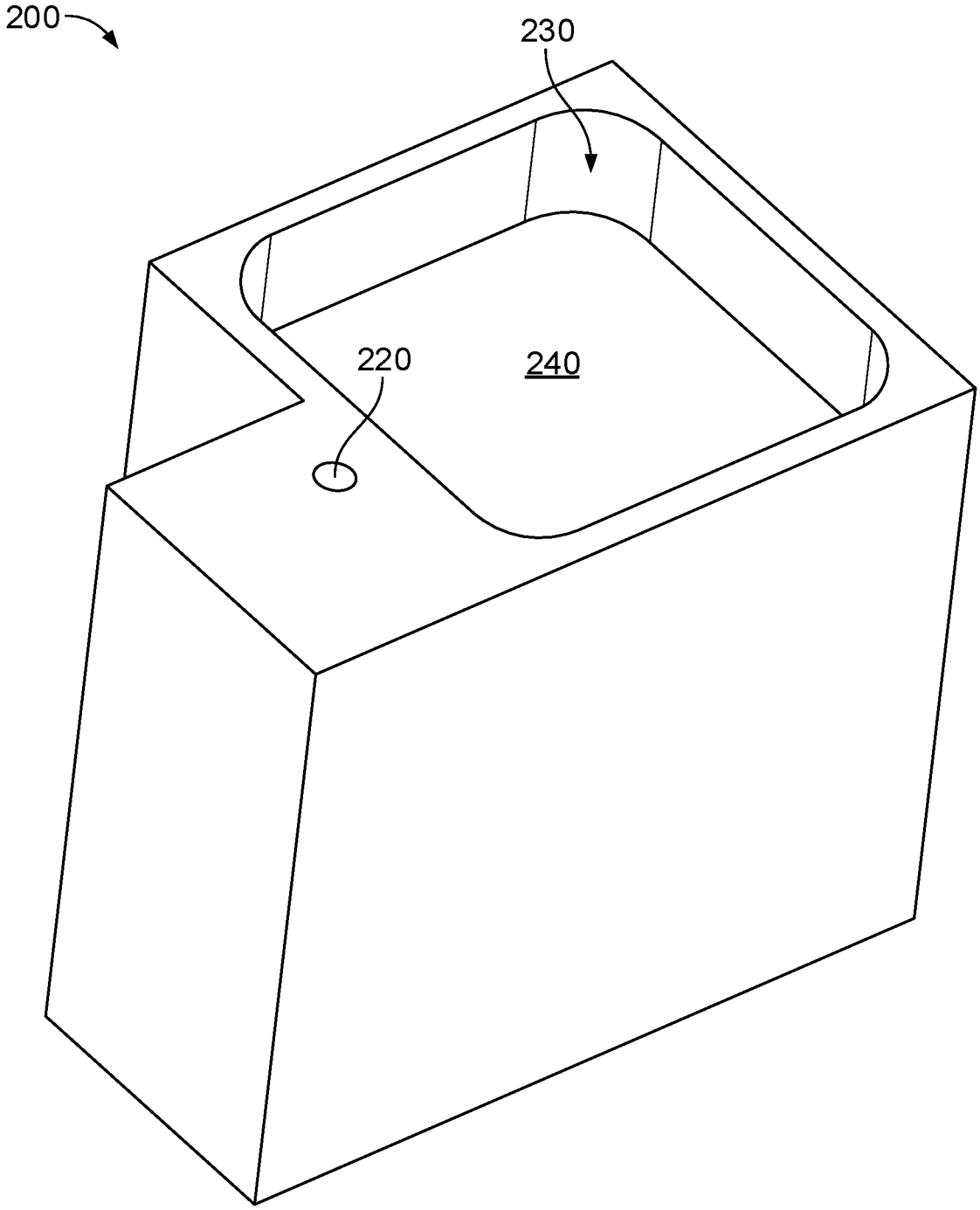
FIG. 2 (Prior Art)
FIG. 2 shows an example of a conventional single-stage ink receptacle.

FIG. 2 shows an example of a conventional single stage ink receptacle 200. The receptacle 200 defines a chamber 230 configured to hold a quantity of hot melt ink 240. In the shown implementation, the quantity of ink has a volume of approximately 1.5 liters. Many hot melt inks expand and shrink with respect to the walls of the chamber 230, e.g., aluminum walls, during heating and cooling periods. The receptacle 200 also includes a heating element 220, which can have a wattage rating (for example, expressing the maximum power that a device can safely handle continuously) between 400 Watts (W) to 800 W. Typically, the single stage ink receptacle 200 can be located within an ink reservoir of a printing system, such as the ink reservoir described previously with reference to FIG. 1.

Figure 3A:
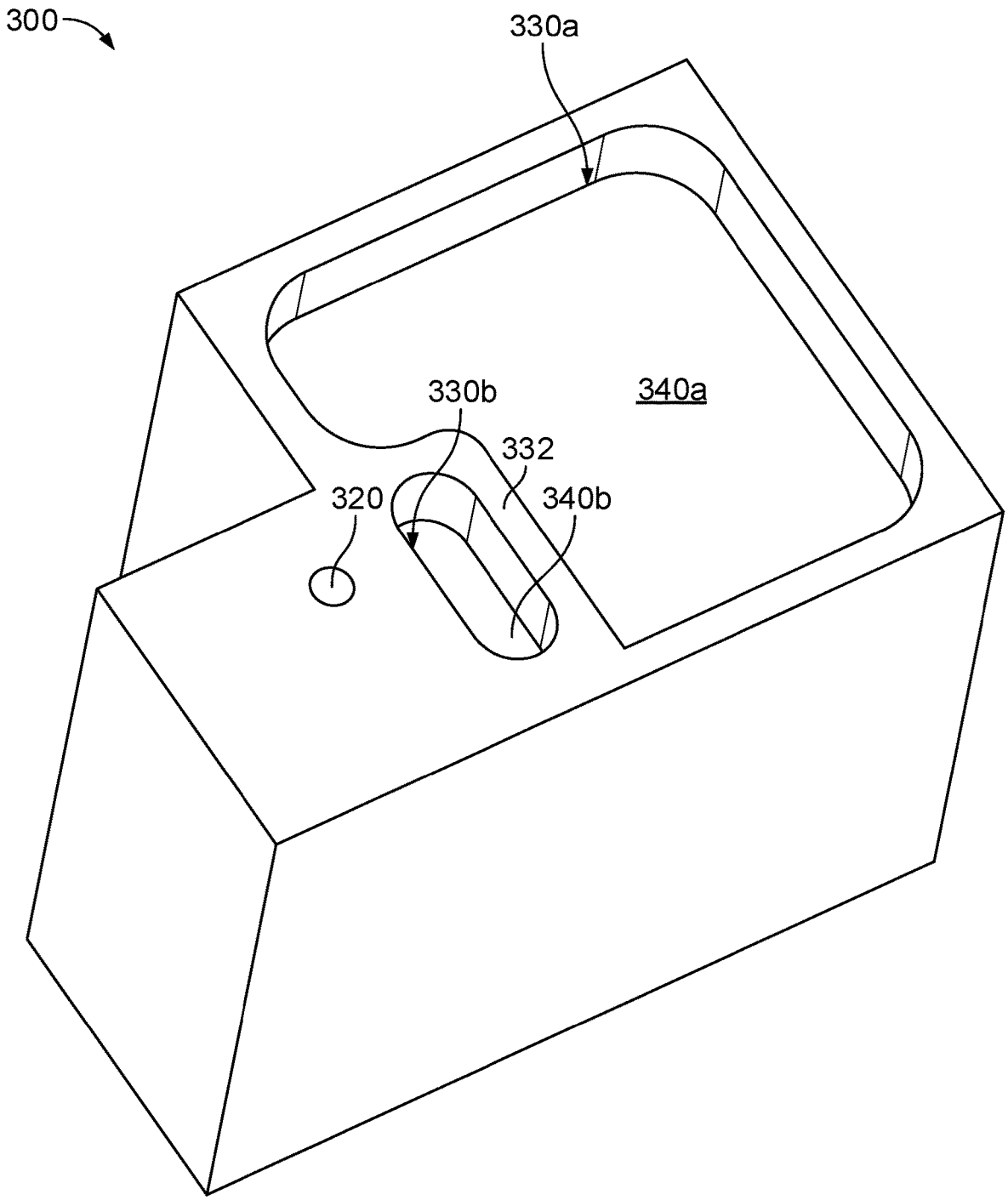
FIGS. 3A-3B show an example of a two-stage ink receptacle.
Figure 3B:
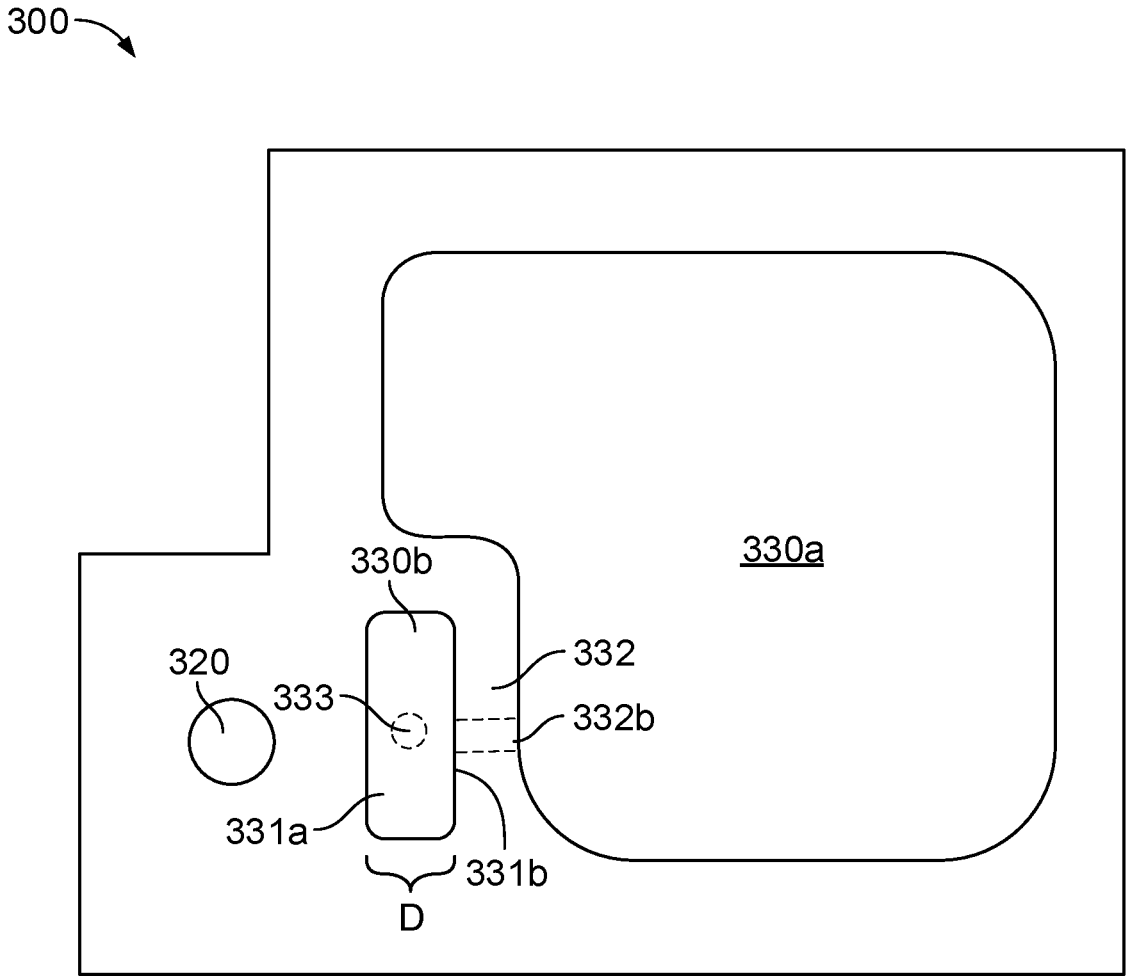

FIGS. 3A-3B show an example of a two-stage ink receptacle 300. The ink receptacle 300 can be used with DOD printing systems, such as the printing system 100 described previously with reference to FIG. 1 (located, for example, within the ink reservoir) or the printing system 900 described later with reference to FIG. 9A.

The receptacle 300 defines a chamber to receive ink having a first portion 330*a* and a second portion 330*b*. The first portion 300*a* forms a primary reservoir and the second portion 300*b* forms a secondary reservoir. As shown, the first portion 300*a* is larger than the second portion 300*b*. The first portion 300*a* is designed to hold a first quantity of ink 340*a*, and the second portion 300*b* is designed to hold a second quantity of ink 340*b*. In the illustrated implementation, the first quantity of ink has a volume of 1.35 liters (L), and the second quantity of ink has a volume of 120 milliliters (mL). However, in other implementations, the size of the first portion 300*a* and the second portion 300*b* are designed to hold larger or smaller quantities of ink. In some cases, based on printing needs, it can be advantageous for the volume of the second quantity of ink to be equal to greater than 120 mL to provide sufficient ink for printing after a short heat up time. The size of the first portion 300*a* and the second portion 300*b* can be based on factors such as printing needs, ink shrinkage percentage(s), and the melting point of the ink used, among others.

The ink receptacle 300 is manufactured from a heat conducting material, such as aluminum. The receptacle 300 includes a heating element 320 configured to heat the receptacle. In some implementations, the heating element 320 has a power wattage rating between 200 W and 800 W. In some implementations, the heating element 320 includes a 48 volt (V) direct current (DC) heater. Although the shown implementation includes just one heating element 320, in other implementations, the receptacle 300 includes more than one heating element 320 (for example, such as the implementations described with reference to FIG. 6). The first portion 300*a* and the second portion 300*b* are separated by a barrier 332.

Referring to FIG. 3B, the second portion 300*b* includes a first heat conducting surface 331*a* and a second heat conducting surface 331*b*, which are separated by an offset (D). The offset (D) can be based on factors, such as a desired heat transfer rate, the melting point of the ink, ink shrinkage percentage, and practical constraints imposed by the particular printing system, among others. In the shown implementation, the barrier 332 includes one or more openings 332*b* that allow melted ink to flow from the first portion 300*a* to the second portion 300*b*. The second portion 300*b* also includes an inlet port 333 that can be in fluid communication with the print heads of a printing system via a pump and ink line (for example, as described later with reference to FIG. 9A). Although the shown implementations describes a barrier 332 that includes openings 332*b*, in some implementations, the barrier 332 does not include any openings. In such implementations, each of the portions 300*a*, 330*b* include a respective inlet port in fluidic communication with the print heads.

During startup of the printing system using the receptacle 300 (for example, the printing system 100 described previously with reference to FIG. 1 and the printing system 900 described later with reference to FIG. 9A), the heating element 320 is caused to begin heating the receptacle 300, and thereby the ink inside the first portion 300*a* and the second portion 300*b*. Once the ink inside the second portion 300*b* reaches its peak melting point (~60° C.), the convection currents in the liquid phase accelerate the process of conducting heat and raise the ink temperature to ~120° in 3-5 minutes. The melted ink of the second portion 300*b* exits the receptacle 300 through the inlet port 333 and flows towards the print head of the printing system (for example, as described later with reference to FIG. 9A). This ink volume along with partial molten ink in the first portion 300*a* can satisfy typical printing needs (for example, up to 3.75 ml/min) for a substantial amount of time (for example, up to 45 Minutes). This interval can allow the un-melted solid block of ink in the center of the first portion 300*a* to melt and flow through the one or more openings 332*b*, replenishing the second portion 300*b* to ensure continuous printing.

Printing systems (such as the printing system 100 described previously with reference to FIG. 1 and the printing system 900 described later with reference to FIGS. 9A-9C) using the receptacle 300 (or other receptacles discussed in this specification, such as the receptacles discussed later with reference to FIGS. 6 and 8A-8B) can support printing at the end of a short heating period (for example, less than or equal to 15 minutes), as the design of the receptacle 300 can provide a sufficient volume of melted ink to allow continuous printing after the short heating period. The second portion 300*b* in receptacle 300 (or second portion 630*b* & 830*b* in receptacles 600 and 800) prevents some hot melt inks from shrinking away from the aluminum walls during a cooling period. This can ensure that the solid hot melt ink, during cold start up, is always in contact with the walls (e.g., the aluminum walls) of the second portion 300*b*, stimulating heat conduction from surrounding walls. Furthermore, unlike conventional technology, during melting, the design of the receptacle 300 can reduce the likelihood that solid mass(es) of ink that have not melted within the short heating period will plug the inlet port 333 (which can be in fluidic communication with a pump that pumps the melted ink to the print heads) and starve the printing system.

Figure 4:
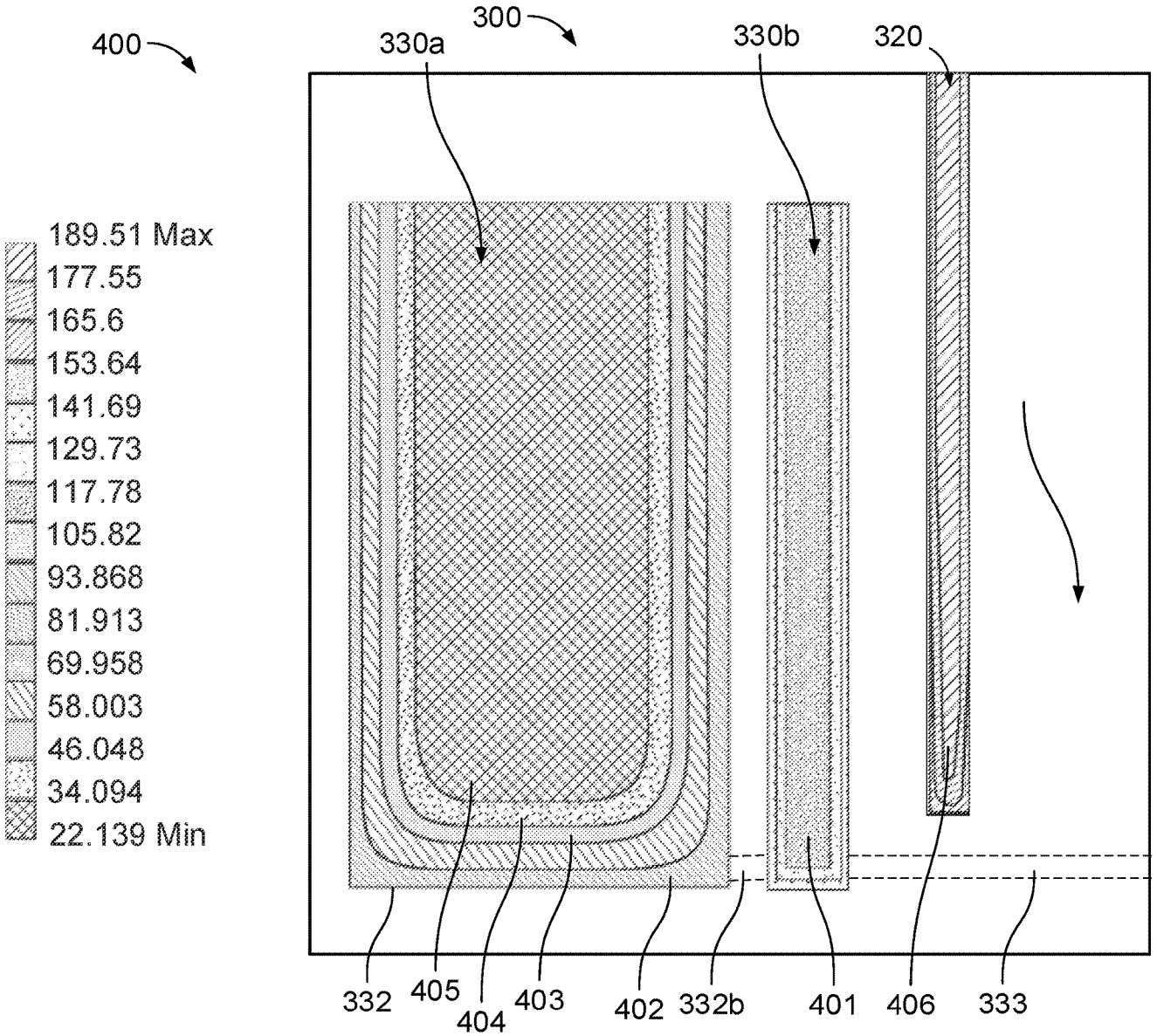
FIG. 4 shows a simulation result relating to the two-stage ink receptacle of FIGS. 3A-3B.

FIG. 4 shows a simulation result 400 relating to the two-stage ink receptacle of FIGS. 3A-3B. Approximate temperature ranges for the regions 401-406 indicated in FIG. 4 are as set forth in the following table.

| Region | Temperature Range (Celsius) | |
|---|---|---|
| No. | Low | High |
| 401 | 69.958 | 153.64 |
| 402 | 58.003 | 117.78 |
| 403 | 46.048 | 58.003 |
| 404 | 34.094 | 46.048 |
| 405 | 22.139 | 34.094 |
| 406 | 165.6 | 189.51 |

As shown, the heating element, having a 700 W rating, can be used to heat the receptacle 300 for 900 seconds (15 minutes). At 15 minutes, the entire ink volume inside the second portion 300*b* in the two-stage receptacle 300 is comfortably above its peak melting point (60° C.) (e.g. Region 401). At the end of the 15 minutes, the melted ink of the second portion 300*b* can begin to be pumped through the inlet port 333 to the print head(s) of the printing system for printing operations. As FIG. 4 also shows, some of the ink in the first portion 300*a* has also melted (e.g., Region 402). This melted ink can flow through the opening 332*b* to replenish the amount of ink in second portion 300*b* as ink begins to leave that portion 300*b*. Thus, continuous printing operations can begin at 15 minutes, while providing enough melted ink volume to give sufficient time for the ink inside the first portion 300*a* to become completely melted, which can reduce the risk of unmelted ink blocking the inlet port 333 and erroneously starving the printing system during continuous printing operations after the 15 minute heating period.

Figure 5A:
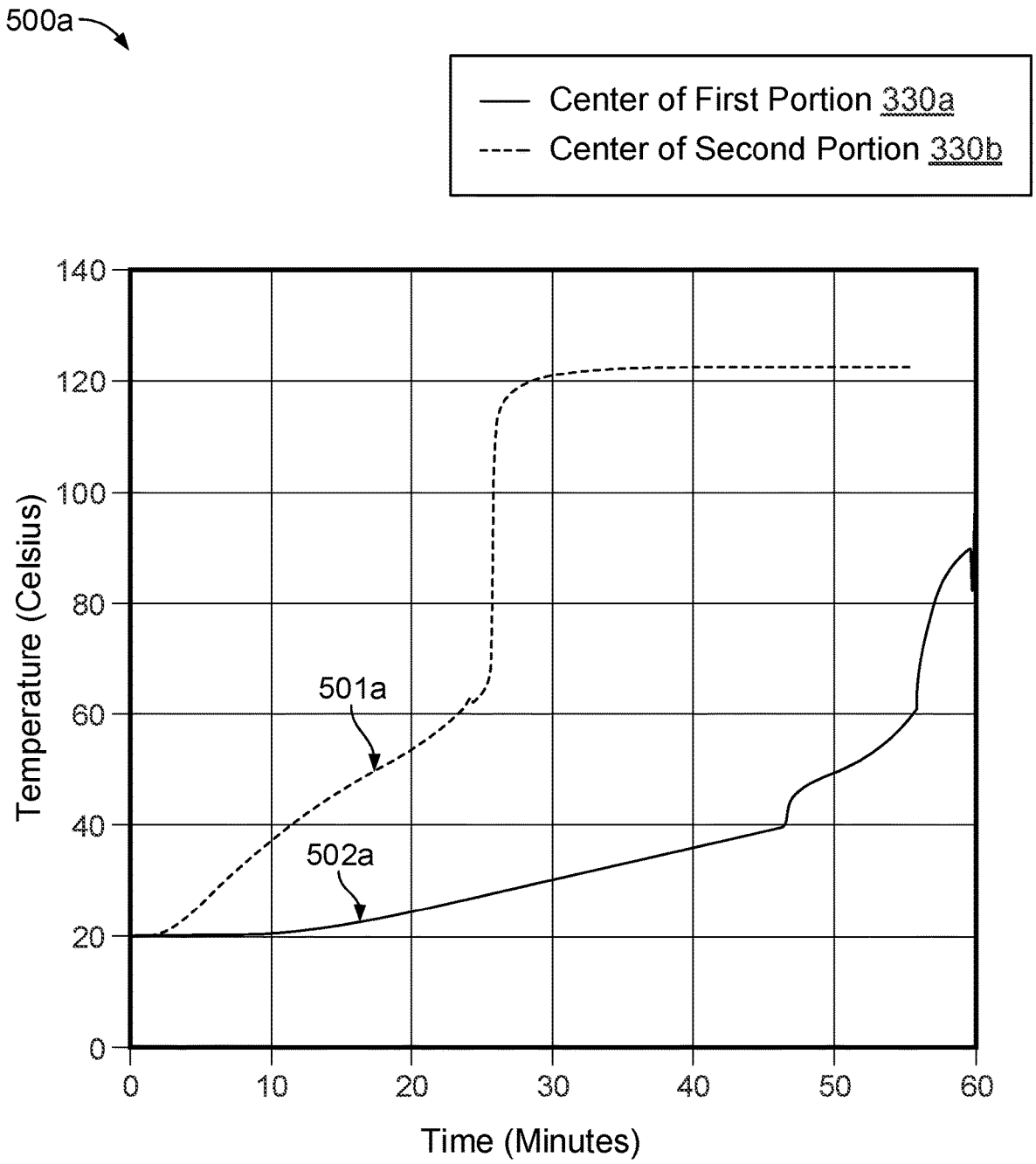
FIGS. 5A-5B are graphs showing the increase in temperature over time during an example use of the two-stage ink receptacle of FIGS. 3A-3B.

FIG. 5A is a graph 500*a* showing the increase in temperature over time during examples of use of the two-stage ink receptacle 300 of FIGS. 3A-3B. Referring to FIG. 5A, the graph 500*a* shows an experiment in which a 400 W heater was used to heat the ink of the first and second portions 300*a*, 300*b* of the receptacle 300 in an environment having an ambient temperature of 21° C. Temperature data was collected using thermocouples located in the center of each of the first portion 300*a* and the second portion 300*b*. The dashed curve 501*a* illustrates the transient temperature behavior of hot melt ink at the center of the second portion 300*b*, and the solid curve 502*a* illustrates the transient temperature behavior of hot melt ink at the center of the first portion 330*a*. As shown, while using a single 400 W heater, substantially all of the ink in the second portion 300*b* reached its peak melting point (60° C.) at approximately 22 minutes, while substantially all of the ink in the first portion 300*a* reached its peak melting point at approximately 55 minutes.

Figure 5B:
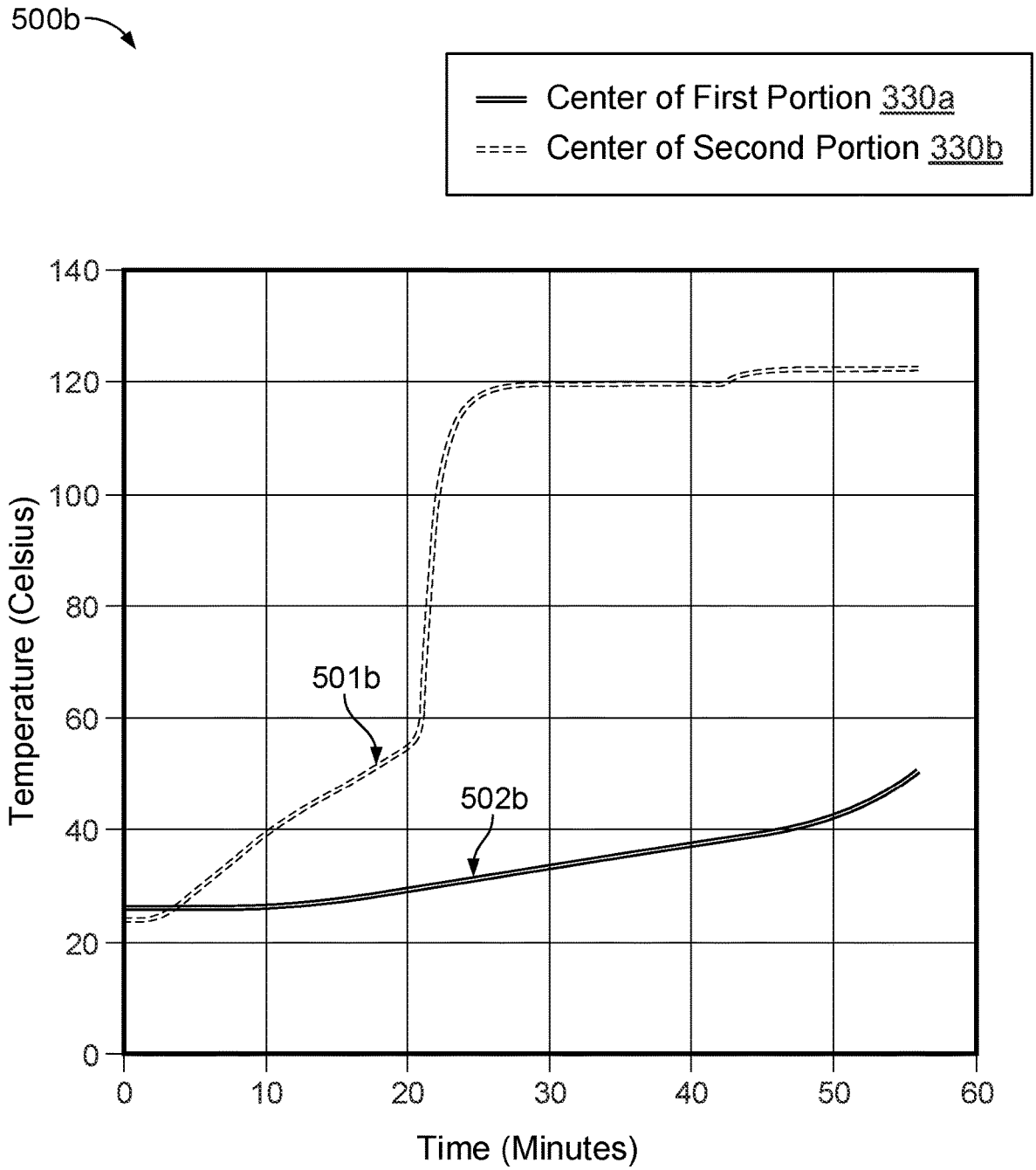

FIG. 5B is a graph 500*b* showing an experiment in which a 600 W heater was used to heat the ink of the first and second portions 300*a*, 300*b* of the receptacle 300 in an environment having an ambient temperature of 24° C. Temperature data was collected using thermocouples located in the center of each of the first portion 300*a* and the second portion 300*b*. The dashed curve 501*b* illustrates the transient temperature behavior of hot melt ink at the center of the second portion 300*b*, and the solid curve 502*b* illustrates the transient temperature behavior of hot melt ink at the center of the first portion 330*a*. As shown, while using a single 600 W heater, substantially all of the ink in the second portion 300*b* reached its peak melting point (60° C.) at approximately 16 minutes.

The design of the ink receptacle 300 also allows for quicker startup time for multiple different types of inks. For example, compared with inks that have a relatively lower melt point, the ink receptacle 300 can be used with inks having a higher melt point, without having significant impact on the startup time.

Figure 6:
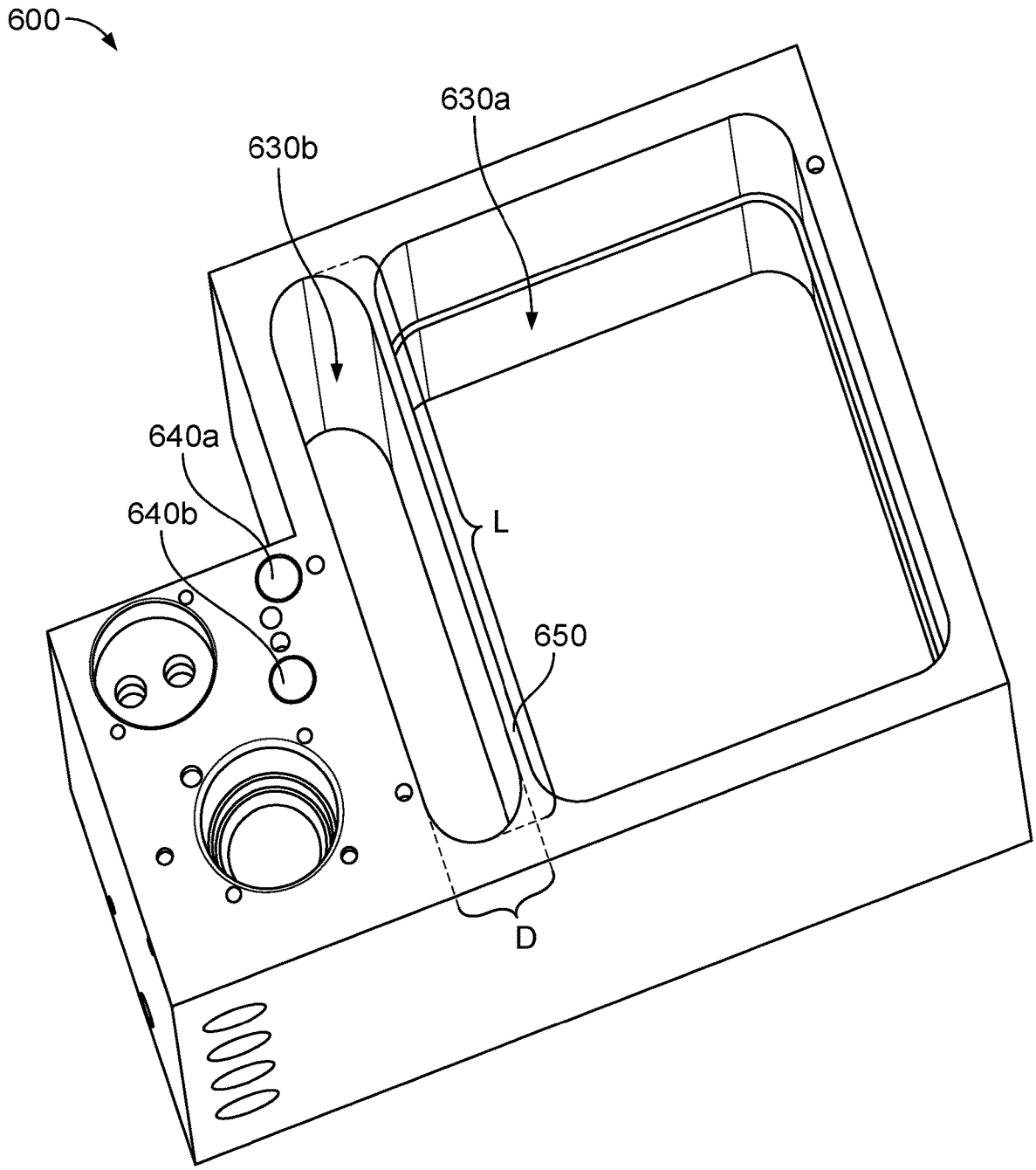
FIG. 6 shows another example of a two-stage ink receptacle.

FIG. 6 shows an example of a two-stage ink receptacle 600. The ink receptacle 600 can be used with DOD printing systems, such as the printing system 100 described previously with reference to FIG. 1 or the printing system 900 described later with reference to FIG. 9A.

The receptacle 600 includes a first portion 630*a* and a second portion 630*b*, separated by a continuous barrier 650 having one or more openings (not shown) to allow ink to flow from the first portion 630*a* to the second portion 630*b*. The receptacle 600 is similar to the receptacle 300 described previously with reference to FIGS. 3A-3B, except the length (L) of the second portion 630*b* is extended relative to the second portion 300*b* of FIGS. 3A-3B, and the receptacle 600 includes two heating elements 640*a*, 640*b* as opposed to one. This extended length may have no (or minimal) impact on the heat transfer rate, as the rate is mostly directly dependent on the width (D), which is the same as the receptacle 300 of FIGS. 3A-3B. This modification can more than double the ink volume in the second portion 630*b* when compared with the receptacle 300 of FIGS. 3A-3B (in the illustrated implementation, the second portion 630*b* is capable of holding up to 263 mL of ink), and, when compared with conventional technology, allow printing after a shorter heating period (for example, less than or equal to 15 minutes) even when the initial ink level in the receptacle 600 is low (for example, approximately 10 millimeters (mm) from the bottom of the receptacle 600). The second portion 630*b* in receptacle 600 (or second portion 300*b* & 830*b* in receptacles 300 and 800) can prevent some hot melt inks from shrinking away from the walls of the second portion 630*b* during a cooling period. This can ensure that the solid hot melt ink, during cold start up, is always in contact with walls (e.g., aluminum walls) in the second portion 630*b*, stimulating heat conduction from surrounding walls. Furthermore, the use of the two heating elements 640*a*, 640*b* can facilitate a multi-stage heating process in which both heating elements 640*a*, 640*b* are turned on at startup to cause quicker heating, and then one of the heating elements 640*a*, 640*b* can be turned off after some time to facilitate power savings and efficient heat regulation at a desired temperature. In some implementations, the two heating elements 640*a*, 640*b* have similar wattage ratings (for example, both can have 400 W ratings). In some implementations, the two heating elements 640*a*, 640*b* have different wattage ratings (for example, one can have a 400 W rating and the other can have an 800 W rating).

Figure 7:
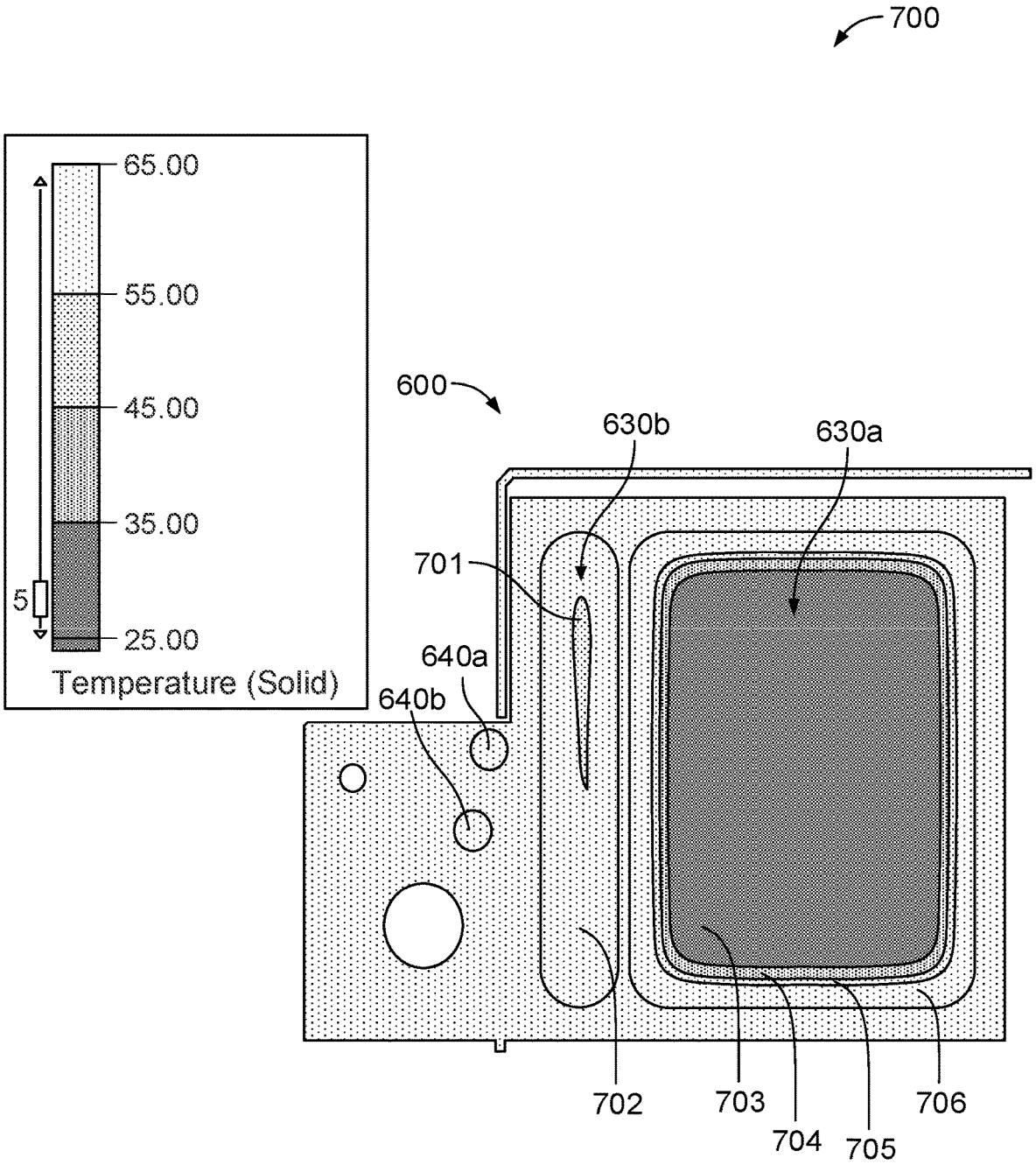
FIG. 7 shows a simulation result relating to the two-stage ink receptacle of FIG. 6.

FIG. 7 shows a simulation result 700 of the two-stage ink receptacle 600 of FIG. 6. The simulation result 700 shows the temperature distribution of the ink receptacle 600 at the end of 15 minutes using two 400 W heating elements 640*a*, 640*b*. Approximate temperature ranges for the regions 701-706 indicated in FIG. 7 are as set forth in the following table:

| Region | Temperature Range (Celsius) | |
|---|---|---|
| No. | Low | High |
| 701 | 45 | 55 |
| 702 | 55 | 65 |
| 703 | 25 | 35 |
| 704 | 35 | 45 |
| 705 | 45 | 55 |
| 706 | 55 | 65 |

As shown, a substantial portion of the ink in the second portion 630*b* was heated beyond its peak melting point (60° C.) after 15 minutes (see, e.g., regions 701 and 702), and thus printing can begin even though most of the ink in the first portions 630*a* remains well below its peak melting point temperature (see, e.g., regions 703-705).

Figure 8A:
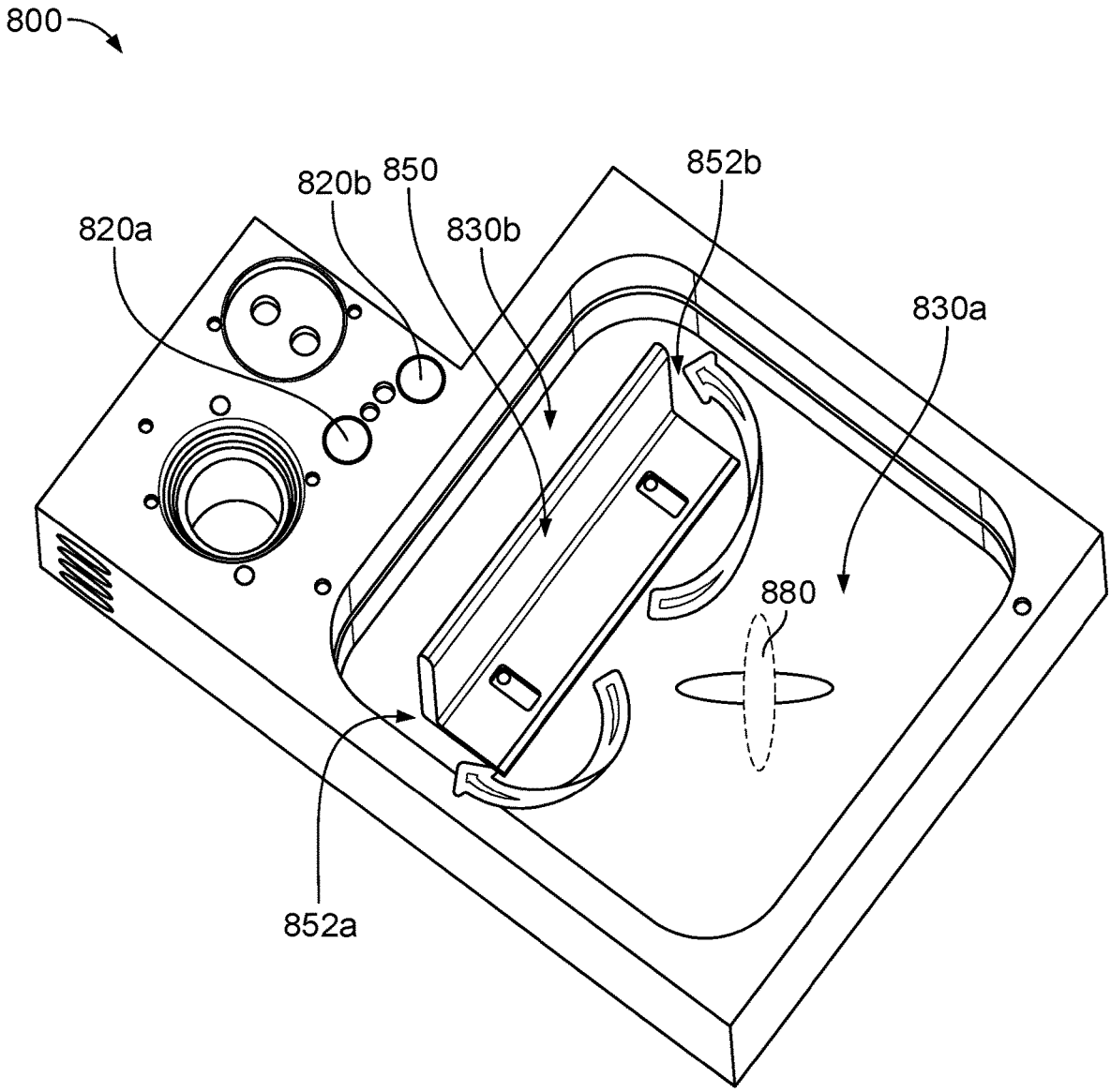
FIGS. 8A-8B show yet another example of a two-stage ink receptacle.
Figure 8B:
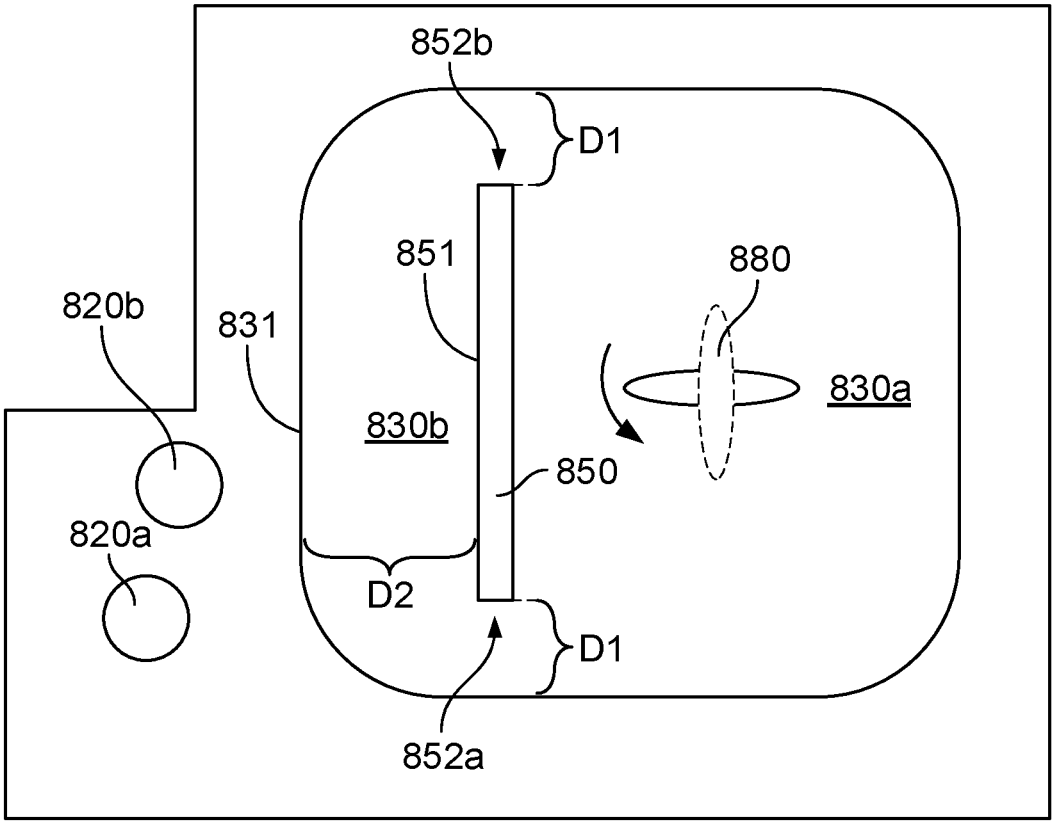

FIGS. 8A-8B show an example of a two-stage ink receptacle 800. The ink receptacle 800 can be used with DOD printing systems, such as the printing system 100 described previously with reference to FIG. 1 or the printing system 900 described later with reference to FIG. 9A.

Referring to FIG. 8A, the receptacle 800 includes a first portion 830*a*, a second portion 830*b*, a first heating element 820*a*, and a second heating element 820*b*. The receptacle 800 is similar to the receptacle 600 described previously with reference to FIG. 6, except that the first portion 830*a* and the second portion 830*b* are separated by a baffle plate barrier 850 as opposed to a continuous barrier. The baffle plate barrier 850 can provide two openings 852*a*, 852*b* at respective ends of the baffle plate barrier to allow ink to flow from the first portion 830*a* to the second portion 830*b*. These openings 852*a*, 852*b* can enable the first portion 830*a* to replenish the second portion 830*b* immediately after a short heating period (for example, less than or equal to 15 minutes). This can allow continuous printing even when the initial ink level is low (for example, approximately 10 mm from the bottom of the receptacle 800). The second portion 830*b* of receptacle 800 (or second portion 630*b* & 300*b* in receptacles 600 and 300) can prevent some hot melt inks from shrinking away from the aluminum walls during a cooling period. This can ensure that the solid hot melt ink, during cold start up, is always in contact with the walls (e.g., the aluminum walls) of the second portion 830*b*, stimulating heat conduction from surrounding walls. Also, the design of the receptacle 800 can facilitate the use of pigmented inks, as the openings 852*a*, 852*b* on the ends of the baffle plate barrier 850 allow liquid ink to be re-circulated (aided by a stirrer 880) between the first portion 830*a* and the second portion 830*b* to avoid settling of heavy pigments.

The receptacle 800 includes two design dimensions D1, D2. The first design dimension D1 represents the width of the openings 852*a*, 852*b* at the ends of the baffle plate barrier 850. Although, in the shown implementation, the dimension D1 is the same for both openings 851*a*, 852*b*, in some implementations, the width of these openings are different. In some implementations, the first design dimension D1 is limited (for example, less than or equal to 15 mm) to ensure complete melting of ink on the edges of the second portion 830*b* after a short heating period (for example, less than or equal to 15 minutes). If the size of this dimension D1 is substantially limited (for example, less than 10 mm), it can enhance the heat transfer performance, but may hinder the re-circulation of pigmented inks from the first portion 830*a* to the second portion 830*b*. In some implementations, this dimension D1 is fixed at 15 mm to optimize heat transfer performance with respect to ink re-circulation between the portions 830*a*, 830*b*. Although the dimension D1 can be larger or smaller than 15 mm in other implementations, the dimension D1 can be limited to not exceed 15 mm in some implementations to ensure proper melting of ink in the second portion 830*b*.

The second design dimension D2 represents the distance between the surface 851 of the baffle plate barrier 850 that is facing the second portion 830*b* and the surface 831 of the receptacle 800 that runs the length of the second portion 830*b*.The second dimension D2 can directly affect the heat transfer performance of the second portion. Smaller D2 dimensions can ensure good heat transfer within the second portion, but can limit the molten ink volume after the short heating period (for example, less than or equal to 15 minutes) for continuous printing. In some implementations, this dimension D2 is limited between 12-20 mm to optimize heat transfer performance while accounting for the volume of ink needed for continuous printing after shorter heat up times.

Figure 9A:
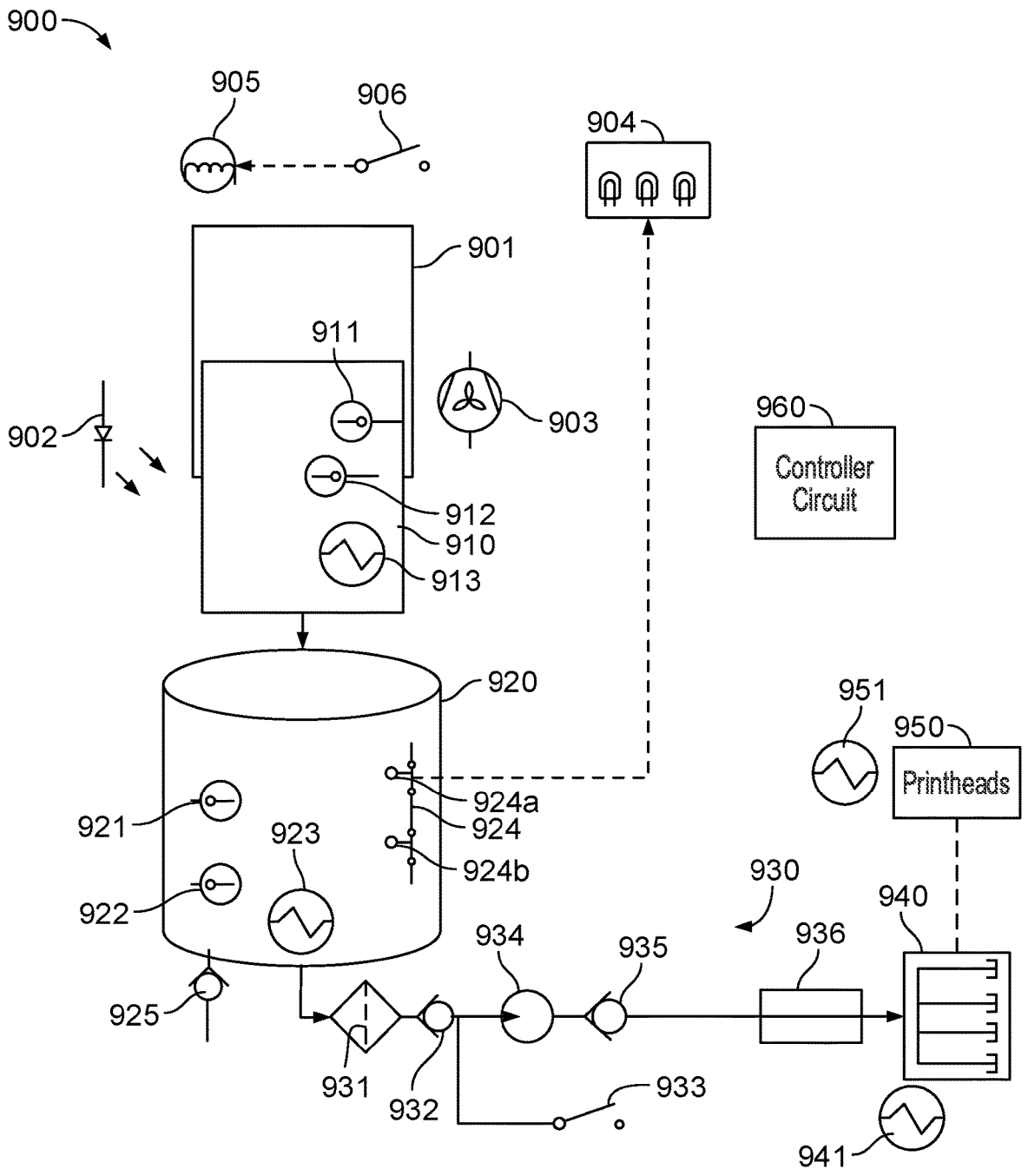
FIGS. 9A-9C show an example of a DOD printing system.
Figure 9B:
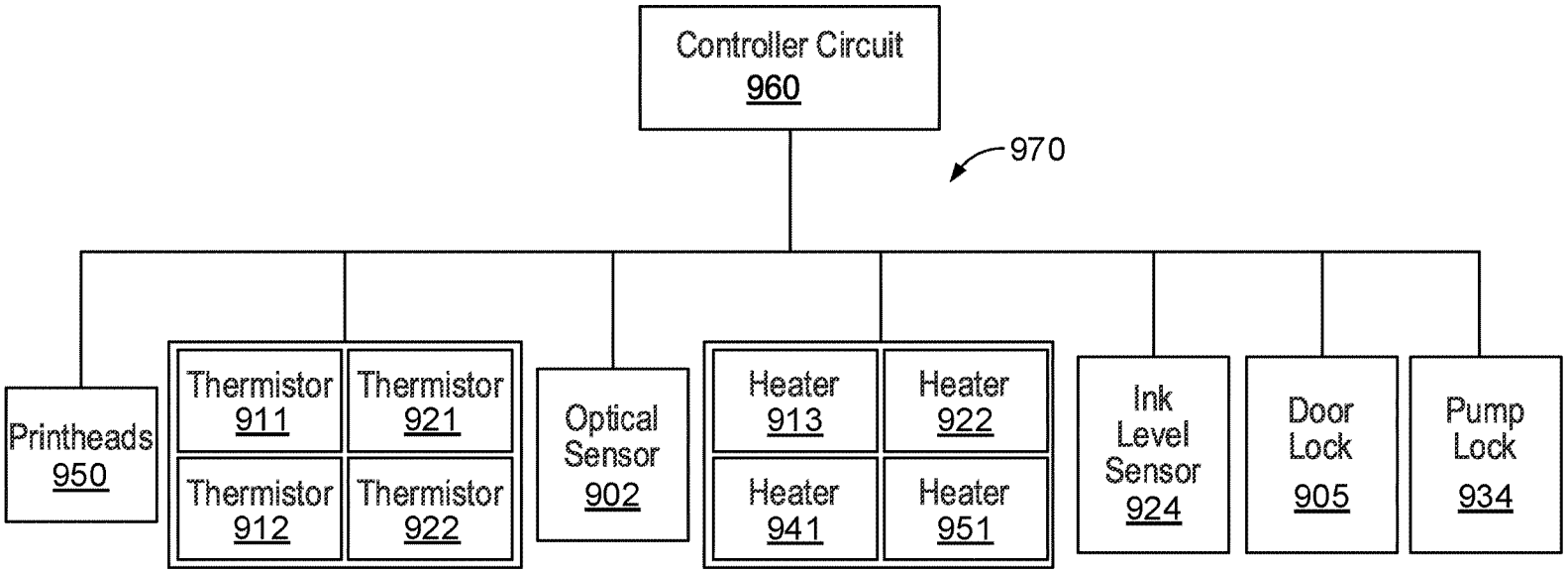
Figure 9C:
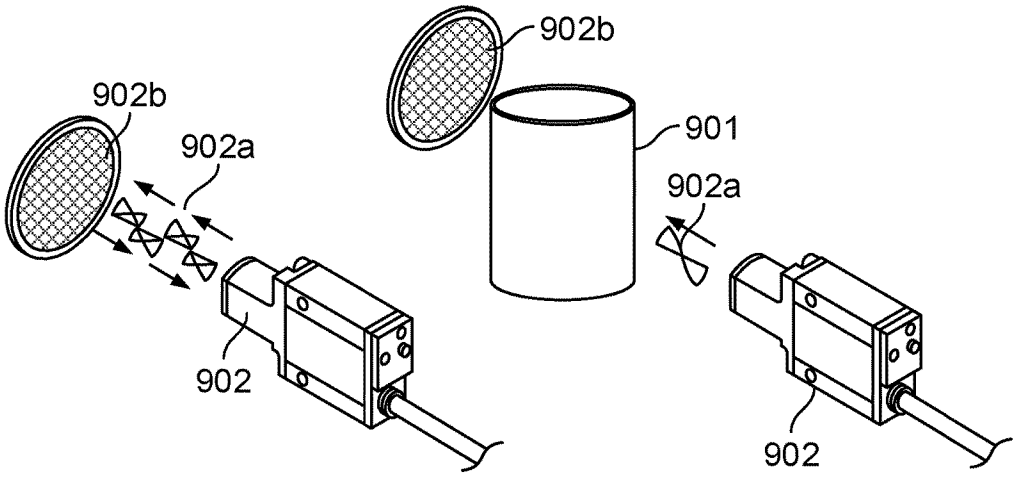

FIGS. 9A-9C show an example of a DOD printing system 900. The printing system 100 described previously with reference to FIG. 1 can include one or more components of the printing system 900. The printing system 900 includes a melt chamber 910, a hold chamber 920, an ink supply system 930, an optical sensor 902, a solenoid door lock 905, and one or more print heads 950. The system 900 includes a controller circuit 960 configured to control operations of one or more components of the system 900.

The melt chamber 910 can be configured to receive and hold an ink bottle 901. The ink bottle 901 can be, for example, a 1 liter recyclable polypropylene bottle. The bottle 901 can be filled with 900 ml of molten ink at 125° C. The ink can then cool to a solid state in the bottle 901 and shrink about 14% in volume during the cooling period. Access to the melt chamber 910 is controlled by a solenoid door lock 905 and an ink door lockout switch 906. Loading ink into the system 900 can begin with accessing the melt chamber 910 (for example, by opening a door of the chamber 910) and loading the bottle 901 into the melt chamber 910. The melt chamber 910 is mechanically designed to prevent the possibility of leaving an access means (such as a door) in an open condition. This can reduce the risk of causing a burn to the operator when the melt chamber 910 begins heating (which can cause an operating temperature of 125° C.) and can prevent dust contamination from entering the system 910.

To prevent the user from coming in contact with heated portions of the melt chamber 910, the solenoid lock 905 physically locks access route(s) to the melt chamber 910. In some implementations, the solenoid lock 905 defaults to the locked state when power is removed and opens only when power to the solenoid 905 is applied. In some implementations, during a melt cycle, when the temperature in the melt chamber 910 rises above 69.9° C., the switch 906 engages the solenoid door lock 905. In some implementations, when the melt chamber cools to below 70° C., it can be considered safe to the user and the solenoid door lock 905 is disengaged so that an empty ink bottle 901 can be removed, and a new ink bottle 901 can be added. To cool the melt chamber 910 after melting a bottle of ink 901, a 68 cubic feet per meter (CFM) 24V DC cooling fan 903 with pulse width modulation (PWM) and tachometer can be used to blow cooling air directly at the melting area. The PWM can operate at 25 kilohertz (kHz) with a duty cycle of 99%.

The melt chamber 910 includes one or more heating elements 913 configured to heat the melt chamber 910 to cause the ink in the ink bottle 901 to melt and flow out of the bottle 901. In some implementations, the one or more heating elements 913 remain off until a new bottle 901 of ink is to be melted. In some implementations, the one or more heating elements 913 include a 48 VDC, 200 W heater. In some implementations, heating elements 913 are provided in the form of a cartridge heater. The melt chamber 910 includes a first hard wired thermistor 911 and a first redundant hard wired thermistor 912, which are configured to sense an over-temperature condition (for example, due to a runaway heating element) and shut down power to the one or more heating elements 913.

Referring to FIG. 9C, the optical sensor 902 is used with the melt chamber 910 to detect the presence of the ink bottle 901. The optical sensor 902 can emit an optical signal 902*a* having a first phase, which can be reflected by a retro reflective element 902*b* (e.g., retro reflective tape) back towards the optical sensor 902 in a second phase. If the second phase is detected by the optical sensor 902, it can be determined (for example, by the controller circuit 960) that there is no ink bottle 901 in the melt chamber 910. The bottle of ink 901 can be placed between the optical sensor 902 and the retro reflective element 902*b* when inserted in the melt chamber 910, blocking the reflection of the optical signal 902*a* or causing the optical signal 902*a* to be reflected at a phase other than the second phase. In such occurrences, it can be determined that the ink bottle 901 is present in the melt chamber 910.

Referring back to FIG. 9A, the hold chamber 920 is in fluidic communication with the melt chamber 910 and configured to receive melted ink flowing out of the bottle 901. In some implementations, the hold chamber 920 includes one of the receptacles 300, 600, 800 described previously in this specification. Therefore, the hold chamber 920 can include a first portion configured to hold a first quantity of ink and a second portion that is smaller than the first portion and configured to hold a second quantity of ink that is less than the first quantity. The hold chamber 920 also includes one or more heating elements 923, which can include one or more of the heating elements 320, 640*a*, 640*b*, 820*a*, 820*b* described previously in this specification. The one or more heating elements 923 are configured to heat the hold chamber 920 to cause ink in the hold chamber 920 to melt. In the illustrated implementations, the one or more heating elements 923 of the hold chamber 920 include a 48 VDC, 400 W heater and a 48VDC, 200 W heater. The shown arrangement can facilitate a start-up time of 15 minutes when both the 400 W heater and the 200 W heater are used during a cold start-up (e.g., starting the system 900 from ambient conditions). In some implementations, once the hold chamber 920 has reached a threshold temperature (for example, 125° C.) the 400 W heater can be shut off (for example, by the controller circuit 960, as discussed later) and the 200 W heater can be used to maintain the threshold temperature. The hold chamber 920 includes a second hard wired thermistor 921 and a second redundant thermistor 922, which are configured to sense an over-temperature condition (for example, due to a runaway heating element) and shut down power to the one or more heating elements 923.

As previously indicated, in some implementations, the hold chamber 920 includes an aluminum sheet metal receptacle designed to divide the hold chamber 920 into a first portion and a smaller second portion where enough ink can melt within 15 minutes after a cold start up to facilitate purge and print operations. Ink pumping can happen if a portion of the ink in the hold chamber 920 is liquid. In some implementations, the second portion is sized such that enough ink can melt to pump ink to 4 print heads, for the equivalent of three, 1.5 second purges per print head, after a warm up time of 15 minutes.

The hold chamber 920 also includes an ink level sensor 924 configured to sense the amount of ink remaining in the hold chamber 920. In the shown implementations, the ink level sensor 924 includes a floating dual position level sensor that includes two switches 924*a*, 924*b*. In some implementations, the sensor 924 is manufactured using stainless steel and combines two single pole single throw reed switches 924*a*, 924*b* contained inside a shaft of the sensor 924. Position sensing can be activated by a magnet carried by the sensor 924. When the sensor 924 is in the vicinity of one of the switches 924*a*, 924*b*, the magnetic field causes the switch to bend and either make contact to close the switch, normally open, or break contact, normally closed. Both the top and bottom reed switches 924*a*, 924*b* are normally open. When the sensor 924 is in contact with the top retaining clip, the top reed switch 924*a* is active (closed). When the float is in contact with the bottom retaining clip, the bottom reed switch 924*b* is active (closed). The sensor 924 is configured to sense three conditions: (1) ink level full, which is detected when the top switch 924*a* is closed and the bottom switch 924*b* is open; (2) ink level OK (which can indicate, for example, the hold chamber 920 contains at least a threshold ink fill amount, such as being at least 30% filled with ink), which is detected when both switches 924*a*, 924*b* are open; and (3) ink level empty, which is detected when the top switch 924*a* is open and the bottom switch 924*b* is closed. The sensor 924 can be configured to activate an alarm module 904 of the printing system 900, e.g., on an alarm tower, to indicate the level of ink in the hold chamber 920 to a user of the printing system 900. The alarm module 904 can include, for example, one or more colored lights or speakers configured to emit an audible sound.

Because the shown ink sensor 924 is configured to float in the ink, when the ink level in the hold chamber 920 drops, the sensor 924 is caused to move to the various switch positions. In some implementations, when the ink level sensor 924 is frozen in ink or when the ink level sensor 924 is floating in molten ink, it will give true readings. However, when the ink is transitioning from frozen to molten, the ink level sensor may give false ink level empty reading. That is, as the ink in the hold chamber 920 melts, the ink around the ink level sensor 924 may remain solid because the thermal mass of the sensor may wick heat away from the ink around it. The denser ink hanging from the ink level sensor 924 may cause the sensor 924 to sink into the molten ink. Accordingly, the following table of conditions can be used for reading the ink level sensor 924:

| | | |
|---|---|---|
| Temperature <50° C. | Assume true reading | If this is a cold start then the ink is frozen. If cooling down, the sensor 924 will freeze onto position. |
| Molten Set Point cooling to ambient | Assume true reading | Ink in center stays molten longest. The sensor 924 will freeze into position. |
| Temperature >50° C.; heating to molten set point and receiving ink level empty reading | Assume false ink level empty reading | Denser solid ink could be hanging on sensor 924 and pulling it down. |
| Temperature >50° C.; heating to molten set point and receiving ink level ok reading | Assume true reading | No danger of melting a new bottle and overflowing the hold chamber 920. Sensor 924 may be in molten ink or frozen in place |
| Heating to molten set point + 30 minutes | Assume true reading | Ink in hold chamber 920 is molten. |

The ink supply system 930 includes a first check valve 932, a piston pump 934, a stroke switch 933, a second check valve 935, a manifold 936, a filter 931, and ink lines 940. The ink passes from the hold chamber 920 through the filter 931 (which can be a stainless steel filter) before being pumped to the print heads 950. In some implementations, the filter 931 is a 10 micron, absolute, filter having an effective filter area can be 20 square inches. In one implementation, filter 931 is between 5 and 10 microns.

The piston pump 934 includes a motor for pumping ink from the hold chamber 920 to the ink lines 940. In the illustrated implementation, the motor is a 24V brushed DC motor. It is capable of operating at 3500 rpm and driving a 5-gear gear train with a 190:1 gear ratio. An eccentric can be attached to the shaft of the motor. The rotation of the eccentric can drive the upward and downward motion of the piston of the piston pump 934, which can draw ink from the hold chamber 920 through the filter 931 and through the first check valve 932 (which can be a 2 PSI stainless steel check valve) into a chamber of the piston of the pump 934. The piston then pushes the ink out of the chamber through the second check valve 935 (which can be a 2 PSI stainless steel check valve) into the manifold 936, which is connected to the ink lines 940. The stroke switch 933 (which is sometimes referred to as a limit switch 933 or a home position sensor 933 or a pump stroke count switch 933) is configured to indicate when the eccentric, attached to the ink pump motor shaft, has completed a rotation. In one implementation, the piston pump includes a 24 VDC gear motor.

The ink lines 940 include 1 to 4 ink lines. In some implementations, the ink lines are manufactured using seamless fully annealed "316" stainless steel tubing. In some implementations, the ink lines 940 are used as passive valves that allow ink to flow to the print heads 950. As shown, the ink lines 940 include a heater 941 to ensure that ink in the ink lines 940 does not become frozen and clog the ink lines 940.

In some implementations, the print heads 950 include one or more print heads discussed previously in this specification, such as the print heads 110 discussed previously with reference to FIG. 1. The print heads 950 also include one or more heating elements 951 for heating the ink the print heads 950 (for example, ink stored in reservoirs of the print heads 950).

The hold chamber 920 also includes a pressure relief valve 925 to relieve pressure of the hold chamber 920 that builds from the check valves 932, 935 and the manifold 936. For instance, during a cold start up, the components of the system 900 can be heated in a specific order to prevent ink expansion pressure from damaging the components of the system 900. The heating elements 923 of the hold chamber 920 can be activated only after the print head(s) 950 and ink lines 940 reach a first threshold temperature (for example, 80° C.). This can create a lag time before the hold chamber's 920 heating elements 923 are activated. To reduce the warm up time of the entire system 900 and facilitate printing operations after a short heating period (for example, less than or equal to 15 minutes), the heating elements 923 of the hold chamber 920 can be activated at the very beginning. To facilitate this, the relieve valve 925 can be used to relieve the ink pressure that builds up from the check valves 932, 935 and the manifold 936. In the shown implementation, the pressure relief valve 925 is installed in the hold chamber 920 and rated at 300 PSI and relieves the pressure as soon as it reaches approximately 260 PSI. In one implementation, the relief valve is rated at 20 bar.

Figure 9D:
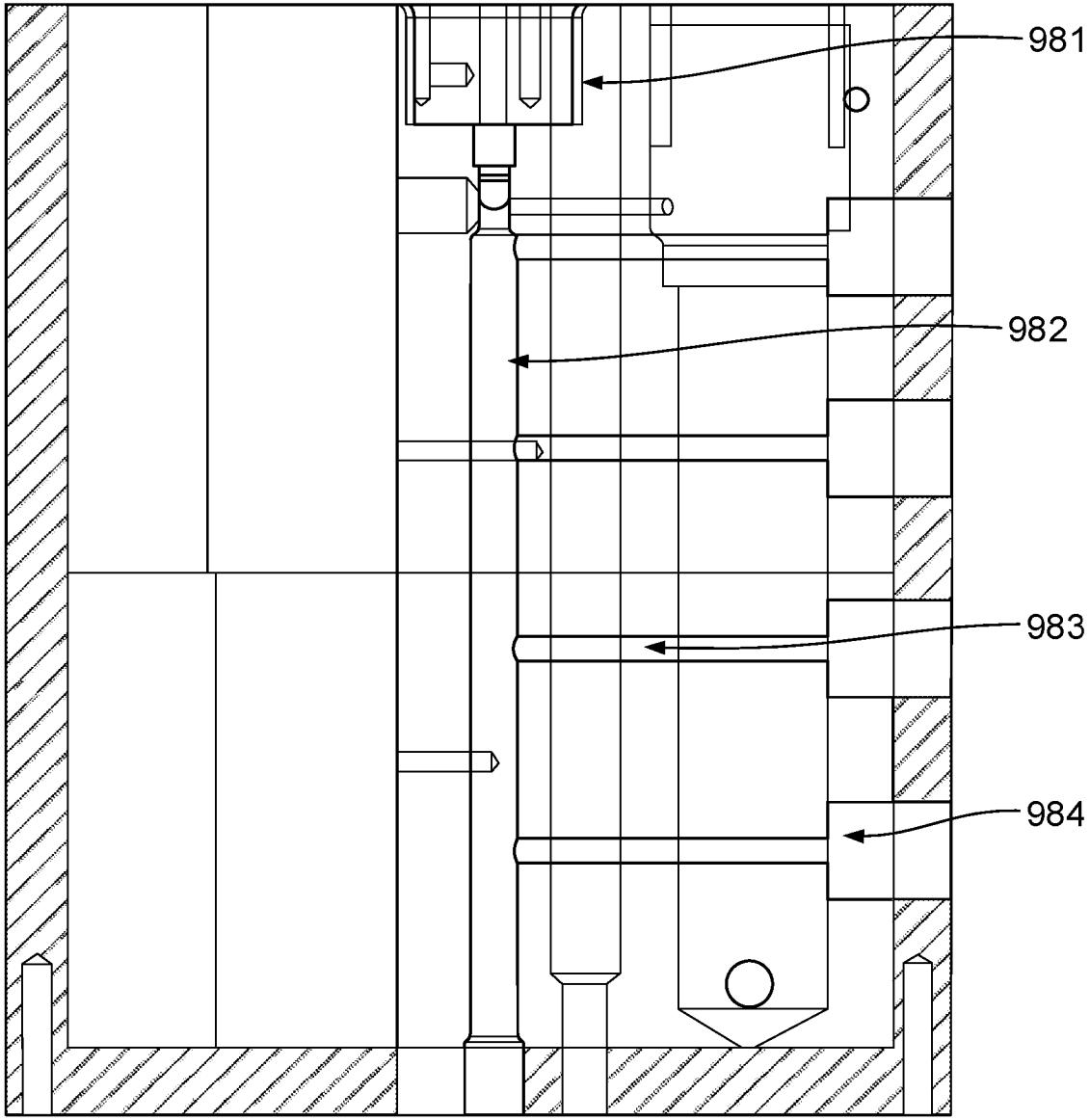
FIGS. 9D-9K show details of various implementations for a pressure relief valve for a hold chamber.

Various implementations are possible for the pressure relief valve 925, and in some implementations, a pressure relief valve is not needed. FIG. 9D shows an example of how the expansion of ink in the hold chamber at startup can create a problem that should be addressed, in some implementations. Hot melt inks can expand by 10% from their solid to fully molten states. The total ink volume after an inlet check valve can be approximately 7.7 ml. Thus, in some cases, this produces 0.77 ml of volumetric expansion that needs to be accommodated, and doing so allows the system to start heating up the IDM at t=0 instead of having to heat up the print head reservoir and ink line first. In FIG. 9D, pump chamber 981 is in fluidic communication with vertical shaft 982. Four horizontal shafts 983 are in fluidic communication with vertical shaft 982. Volume 984 is not occupied by fittings. In one example, pump chamber 981 is 6 mm high by 19.0 mm dia. and has a volume of 1.70 ml. Vertical shaft 982 is 122 mm high by 6.35 mm dia. and has a volume of 3.86 ml. Horizontal shafts 983 are 41.7 mm long by 3.175 mm dia. and have a volume of 1.32 ml each. Volume 984 is 1.55 mm long by 13.1 mm dia. and has a volume of 0.84 ml.

Figure 9E:
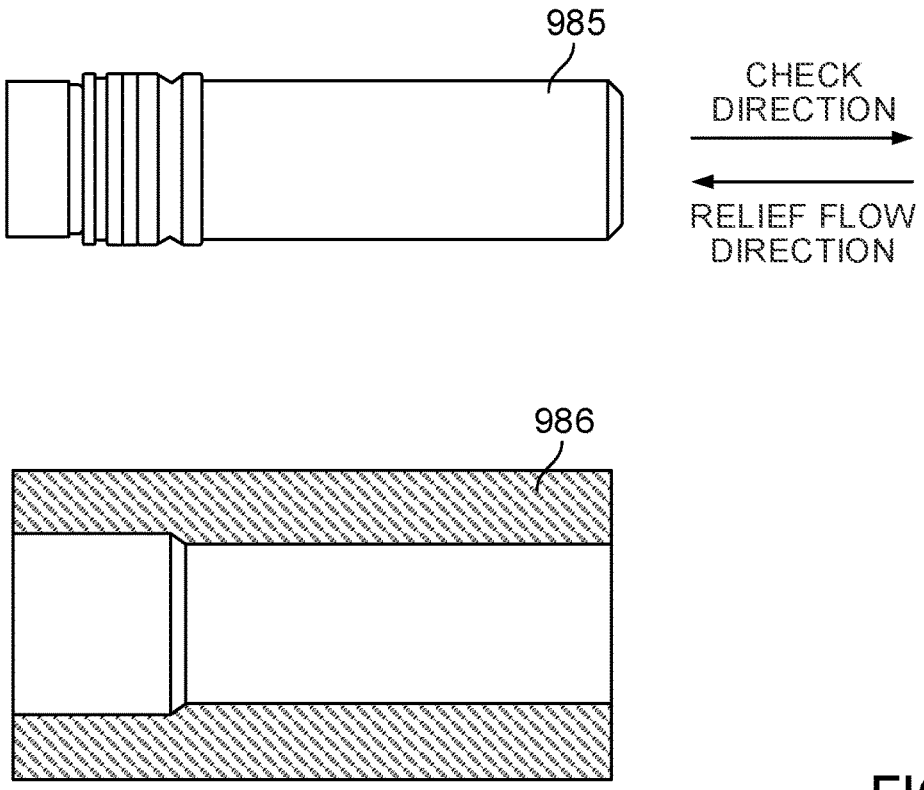

FIG. 9E shows details of an example of a check/pressure relief valve 985 and corresponding installation hole 986. Note that various dimensions and nominal cracking pressures can be used, such as shown in the following table:

| PART NUMBER | NOMINAL CRACKING PRESSURE |
|---|---|
| PCHR55 10020S | 20 Bar (290 psi) |
| PCHR55 10040S | 40 Bar (580 psi) |
| PCHR55 10060S | 60 Bar (870 psi) |
| PCHR55 10080S | 80 Bar (1,160 psi) |
| PCHR55 10100S | 100 Bar (1,450 psi) |

Figure 9F:
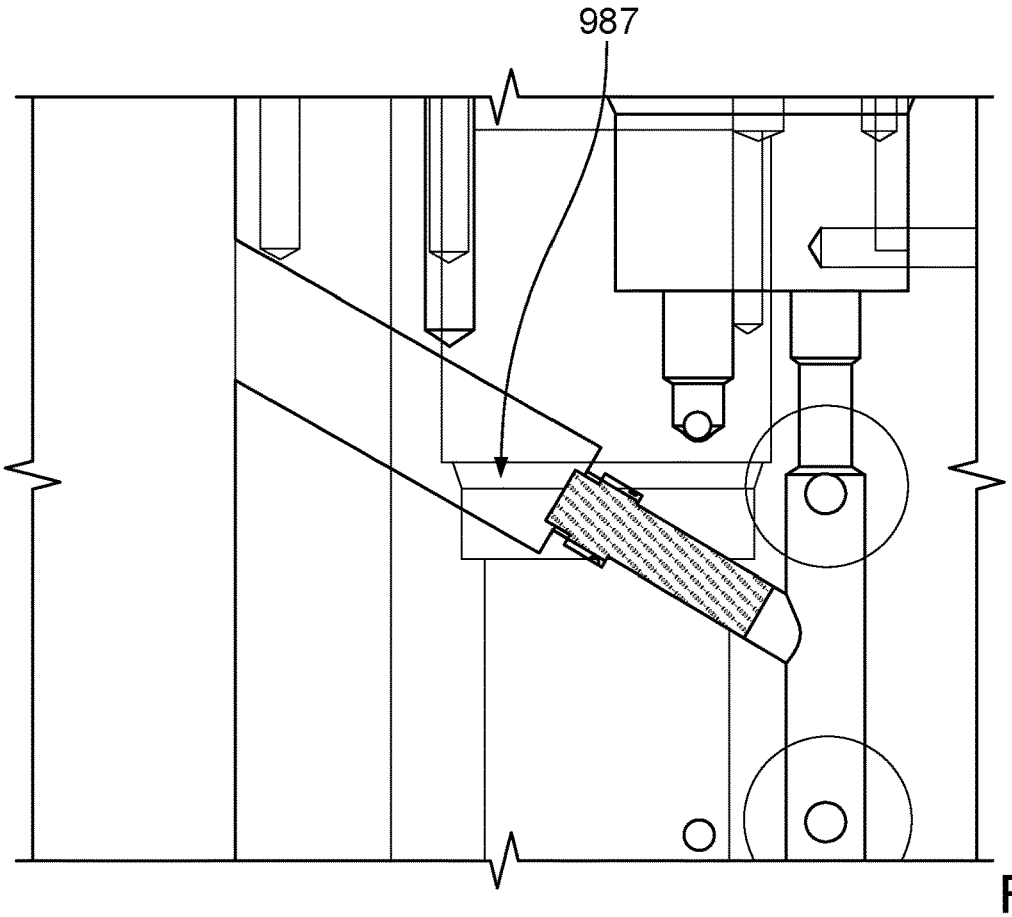

In some implementations, the check/pressure relief valve for the holding chamber is constructed using an internal angle bore 987, as shown in FIG. 9F. This has the advantage of simplicity, as no additional parts are required. However, a disadvantage of this approach is that multi-axis machine tools are required, thus potentially increasing manufacturing costs.

Figure 9G:
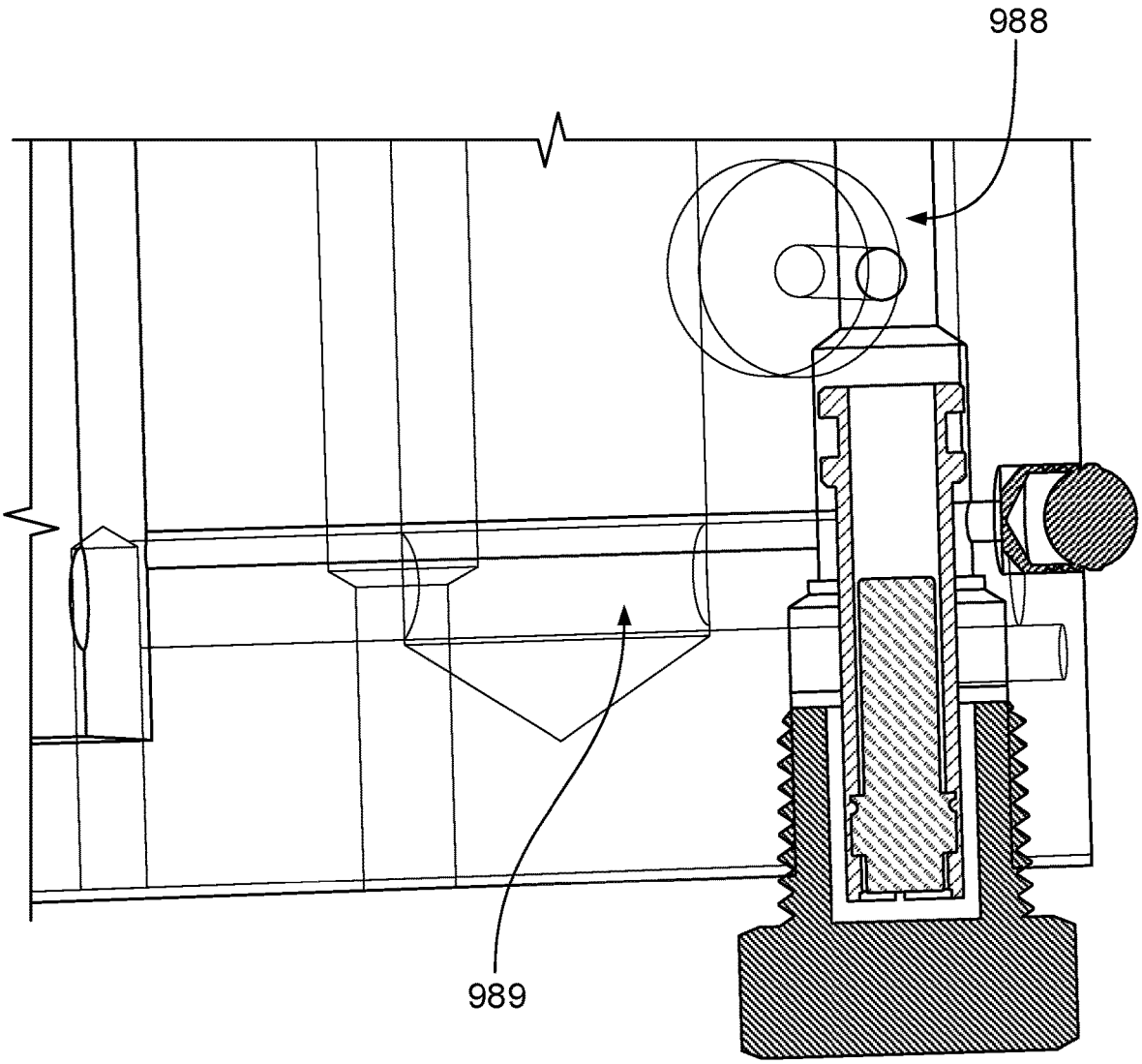

In some implementations, the check/pressure relief valve for the holding chamber is constructed using cross drilled intersecting holes 988, 989, as shown in FIG. 9G. The cross drilled approach would employ a plug with an O-ring sealing gland with the relief valve inserted into it, a pipe thread plug sealing large hole and retaining the relief valve plug assembly and a hole plug sealing the cross drilled hole.

Figure 9H:
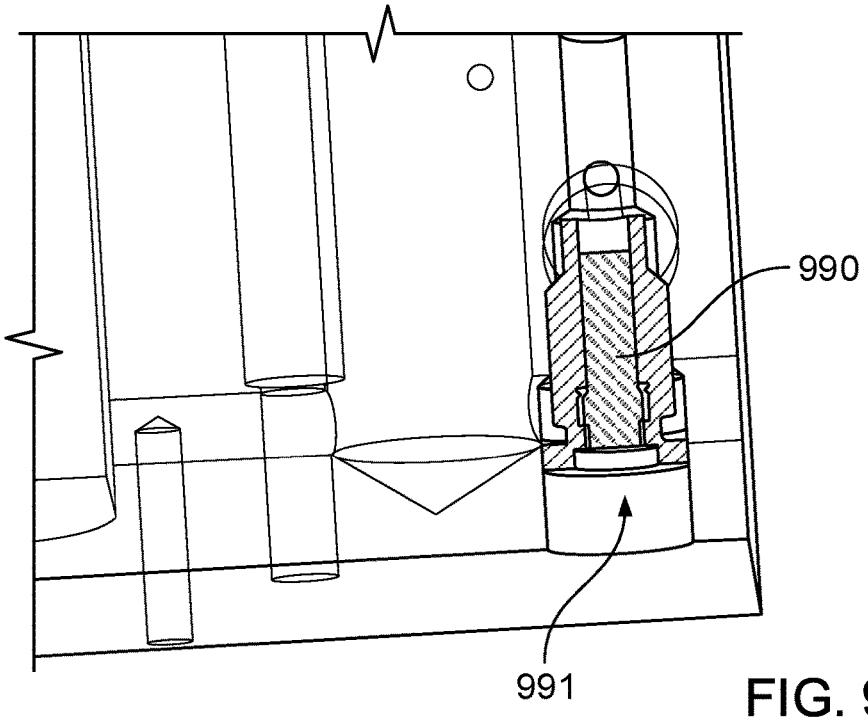
Figure 9I:
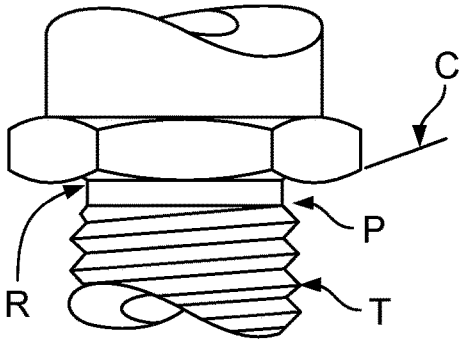
Figure 9J:
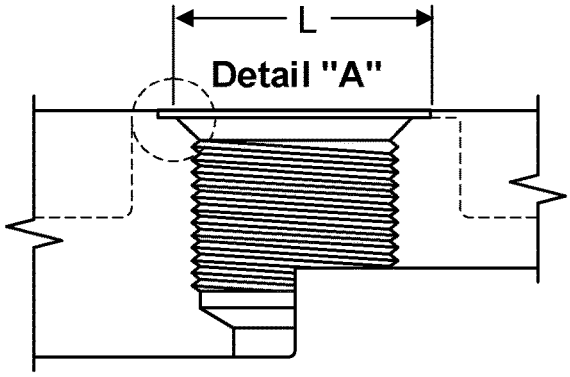
Figure 9K:
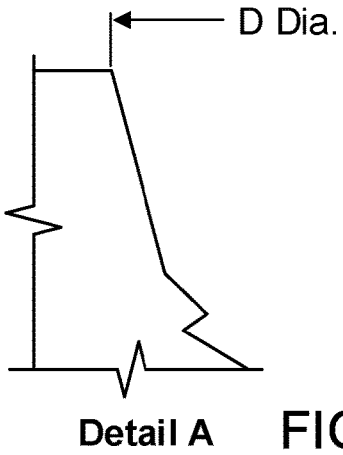

In some implementations, the check/pressure relief valve for the holding chamber is constructed using bottom insertion with external drain, as shown in FIG. 9H. Placing the relief valve 990 at the bottom of the vertical manifold shaft 991 can allow the monitoring of function as well as the ink volumes and velocities. Note that this approach can be used for testing a new design for the holding chamber to determine whether a pressure relief valve is needed, and if so, what characteristics it should have. After validation of the pressure relief valve, the relief valve may be moved to one of the two previously noted locations, kept in this same location for active use in the deployed printing system, or eliminated entirely. Further, as shown and described in the FIG. 9H, the valve can be screwed into a tube fitting boss seal. In some implementations, a tube fitting boss seal is as illustrated in FIGS. 9I, 9J, and 9K. The fitting end can be in accordance with AS4395. Referring to FIG. 9I, location P can include a 0.015 inch radius for thread runout. At chamfer C, chamfer relief to hex flats can be within 15°+/−5°. Radius R can be between 0.016 and 0.031 inches. Referring to FIG. 9J, the front surface can be square with the thread P.D. within 0.010 T.I.R. when measured at Dia. L. Referring to FIG. 9K, diameter D can be concentric with thread P.D. within 0.005 T.I.R. The finished tapered counterbore should be free from longitudinal and spiral tool marks. Annular tool marks up to 100 micro-inches can be allowed.

Referring to FIG. 9B, as previously indicated, the controller circuit 960 can be implemented as hardware or firmware and configured to operate several components of the system 900. In the illustrated implementation, the controller circuit 960 is communicatively coupled, via BUS 970, to the thermistors 911, 912, 921, 922, optical sensor 902, heating elements 913, 923, 941, 951, ink level sensor 924, door lock 905, the print heads 950 and the pump 934. Therefore, the controller circuit 960 is capable of operating these components of the system 900. In some implementations, the controller circuit 960 includes the control devices and control electronics described previously with reference to FIG. 1. The controller circuit 960 is configured to initiate a start-up sequence for the system 900. The start-up sequence can be temperature based and take advantage of the ink properties by measuring temperature versus time. In some implementations, initiating the start-up sequence includes the following:

1. At t=0 (for example, when the user powers-on the printing system 900), if the hold chamber 920 temperature is <50° C., the controller circuit 960 checks the sensor 924 to see if the system 900 is in the ink empty condition. This information can be used to determine if the system 900 will have a 15 minute heat up time, or if a new bottle 901 of ink must be melted before printing can begin.
2. At t=0, all print head heaters 951 are activated, and both heating elements 923 of the hold chamber 920 (which, in the illustrated implementation, includes a 400 W heater and a 200 W heater) are activated. When the ink of any reservoir in one or more of the print heads 950 reaches a first threshold temperature (for example, 80° C., which can be approximately 6 minutes after t=0), the heating elements 941 of the ink lines 940 corresponding to those print heads 950 are activated. In some implementations, 80° C. can provide a margin of safety to allow expansion of ink from the ink line 940 into the print head 950 reservoir without damaging any components. In some implementations, the ink does not need to be completely liquid, just liquid enough that it will allow ink expansion into the print head 950 reservoir.
3. Once the hold chamber 120 temperature reaches a second threshold temperature (for example, 125° C.), the heating elements 941 of the ink lines 940 are deactivated and the heating elements 923 of the hold chamber 120 are caused to regulate the temperature of the hold chamber 920 at a desired temperature (for example, 125° C.).
4. Once each heating element 951 of the print heads 950 reaches 125° C., regulate the print head temperatures at the desired temperature (for example, 125° C.).
5. When all heating elements 923, 951 of the print heads 950 and the hold chamber 920 are regulating at the desired temperature, the controller circuit 960 can cause the system to enter an idle state.

6. After entering the idle state, the controller circuit 960 can wait a threshold amount of time (for example, 30 minutes) before checking the sensor 924 to be sure that all the ink in the hold chamber 920 is melted and the sensor 924 is floating in molten ink.
7. Upon entering the idle state, the controller circuit 960 can cause the 200 W heater of the hold chamber 920 heating elements 923 to take over temperature control for the hold chamber 920. In some implementations, the hold chamber 920 temperature can be held at a set-point range of 125° C.+/−5° C. using the 200 W heater of the heating elements 923. If the temperature drops below the low threshold of the set-point range, the controller circuit 960 can activate the 400 W heater of the heating elements 923 to bring the temperature back into the set point range.

The described start-up sequence can work for cold start up and for scenarios in which a printer is shut off for an extended period of time (for example, more than an hour) and then restarted, such as to service the filter 931. An objective of the heat up sequence can be to start printing within 15 minutes while also assuring that the expansion of the frozen ink does not damage any components of the system 900. In some implementations, if the sensor 924 indicates the ink-empty state at t=0, the controller circuit 960 can initiate an ink melt cycle. In some implementations, printing cannot begin until the sensor 924 indicates at least the ink-OK state (for example, the hold chamber 920 contains a threshold amount of ink, such as being at least 30% filled).

In some implementations, if the sensor 924 was not read at start-up due to the fact that the ink temperature was >50° C., resulting in a potentially false ink empty reading (as previously described), and the sensor 924 indicates ink empty state, the sensor 924 is not read until 30 minutes after entering the idle state and a bottle melt is not initiated. However, if the sensor 924 indicates an ink-OK state or an ink-full state, the controller circuit 960 can activate the pump module 932 and ink can be pumped to the print heads 950, for the equivalent of three, 1.5 second purges per print head 950.

In some implementations, once the 400 W heater of the heating elements 923 of the hold chamber 920 is deactivated, the heating element 913 of the melt chamber 910 is activated to stay within a prescribed power budget for the system 900 (that is, in some implementations, the 400 W hold heater of the hold chamber 920 heating elements 923 and the melt chamber 910 heating element 913 are never powered-on at the same time). In some implementations, the 400 W heater of the heating elements 923 of the hold chamber 920 has priority over the heating element 913 of the melt chamber 910, and if the 400 W heater of the heating elements 923 of the hold chamber 920 needs be powered-on to bring the hold chamber 920 back to the previously described set-point range, the heating element 913 of the melt chamber 910 is deactivated during that duration.

Figure 10A:
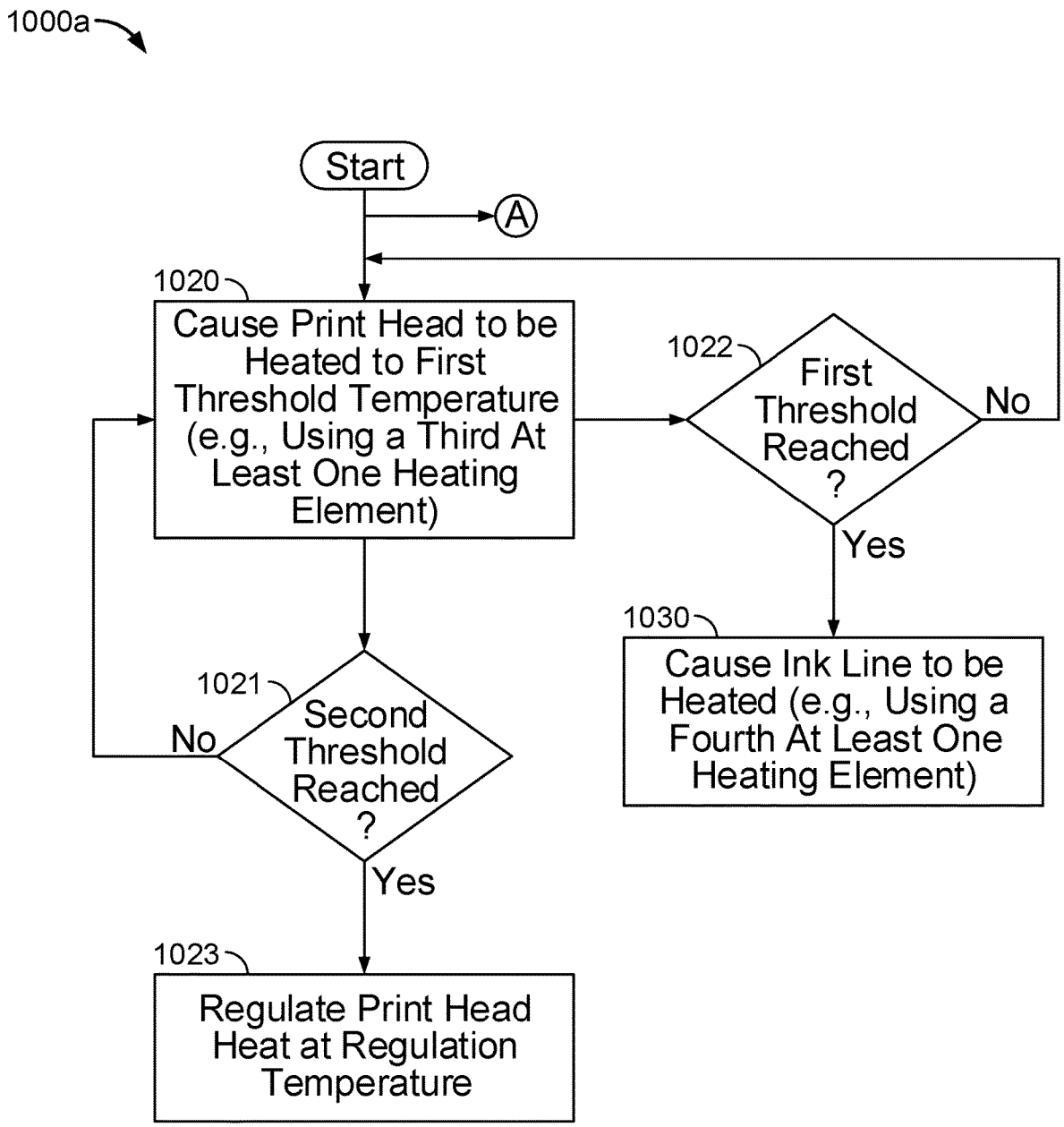
FIGS. 10A-10C show examples of methods of operating a DOD printing system.
Figure 10B:
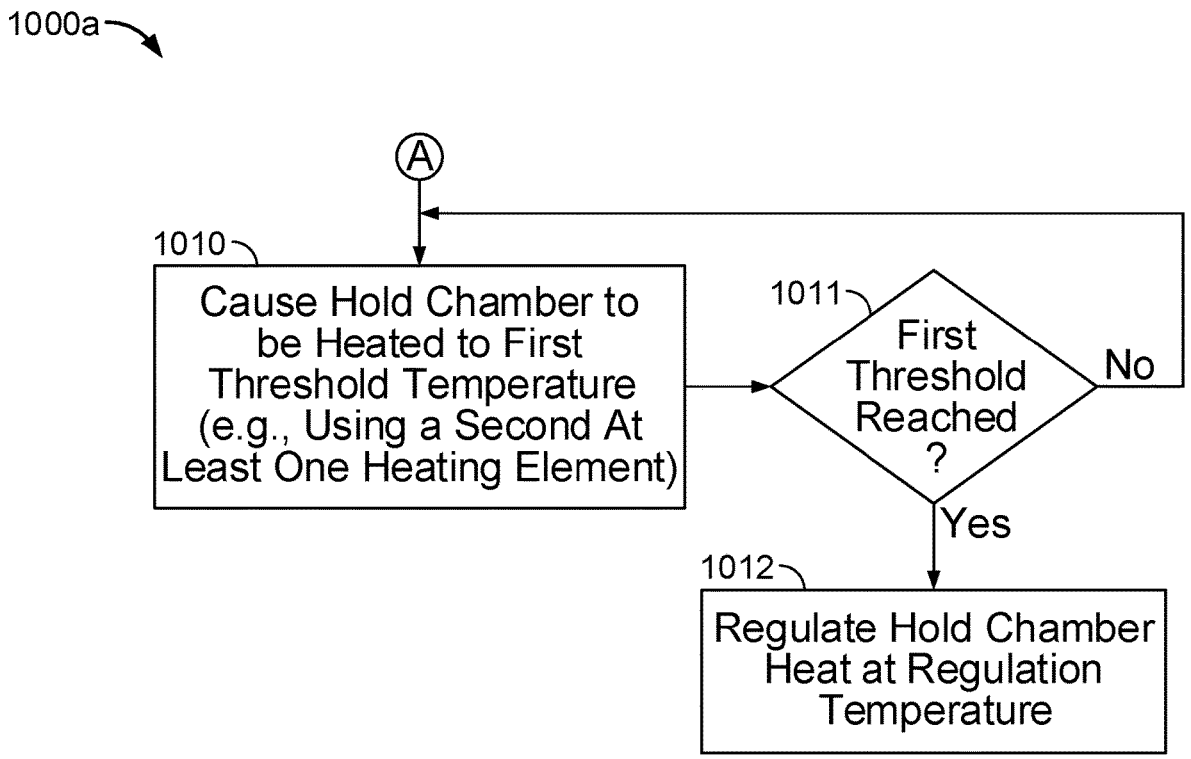
Figure 10C:
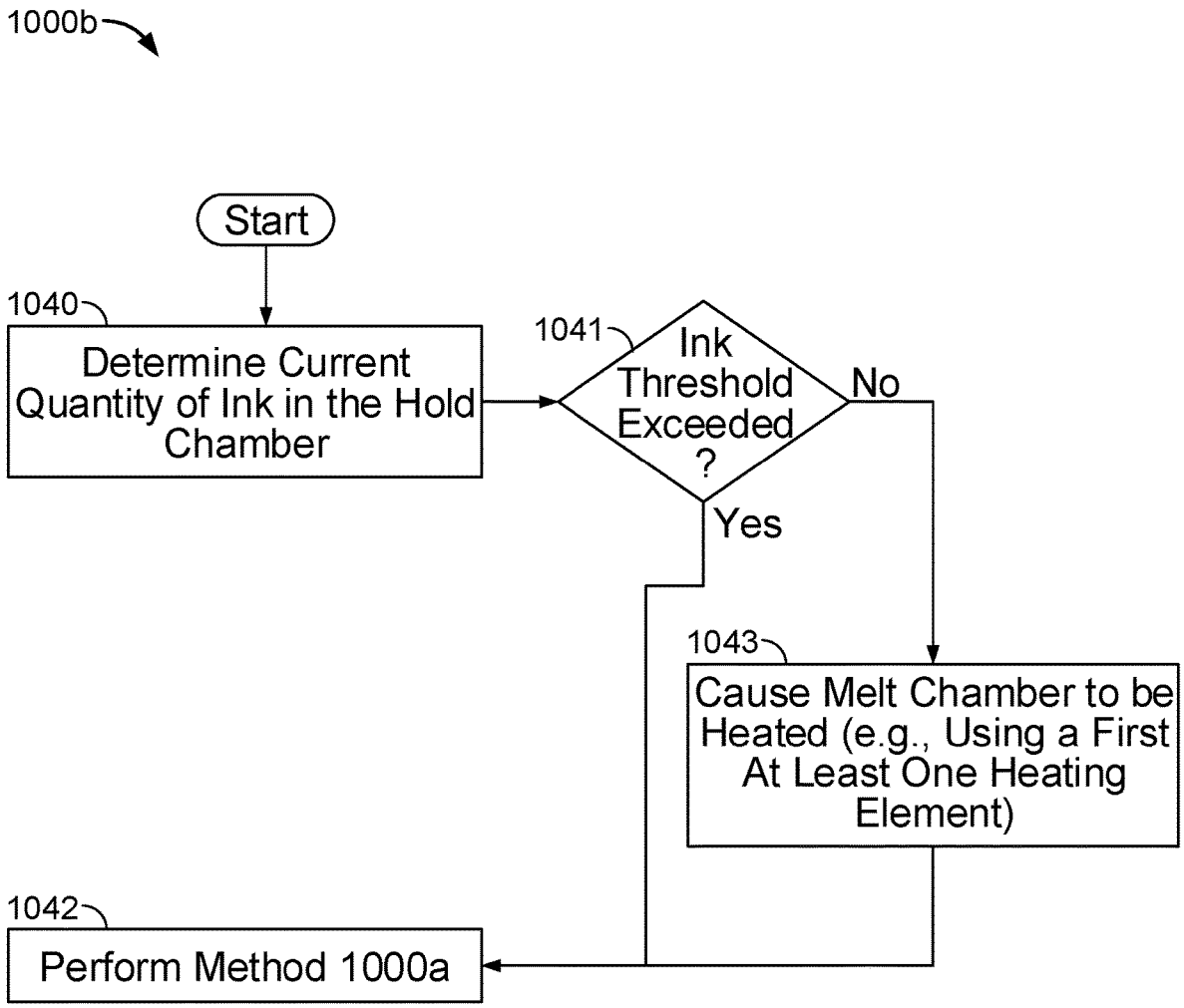

FIGS. 10A-10C show examples of methods 1000*a*, 1000*b* of operating a DOD printing system. In some implementations, controller circuit(s) described in this specification (such as the controller circuit 960 described previously with reference to FIGS. 9A-9C) are configured to perform operations that include one or more portions of the methods 1000*a*, 1000*b*. Referring to FIGS. 10A-10B, the method 1000*a* includes: causing 1010 a hold chamber of the printing system to be heated to a first threshold temperature; causing 1020 a print head of the printing system to be heated to the first threshold temperature; causing 1030 an ink line to be heated after determining 1022 that the print head has been heated to a first threshold temperature; regulating 1023 heating of the print head at a desired regulation temperature after determining 1021 that the print head as been heated to the second threshold temperature; and regulating 1012 heating of the hold chamber at the regulation temperature after determining 1011 that the hold chamber has been heated to the first threshold temperature.

Referring to FIG. 10A, at 1020, at least one heating element is used to heat the print head of the printing system to the first threshold temperature. In some implementations, the first threshold temperature is 125° C. At 1021, it is determined whether the print head reaches a second threshold temperature that is less than the first threshold temperature. In some implementations, the second threshold temperature is 80° C. At 1030, after determining 1021 that the second threshold temperature has been reached, the at least one heating element is used to heat the ink line. At 1022, it is determined whether the print head has been heated to the first threshold temperature. At 1023, after the print head has been heated to the first threshold temperature. After determining 1023 that the print head has been heated to the first threshold temperature, at 1023, at least one heating element is used to regulate the print head at a desired regulation temperature range. In some implementations, the desired regulation temperature range 125° C.+/−5° C.

Referring to FIG. 10B, at 1010, the at least one heating element is used to heat the hold chamber of the printing system to the first threshold temperature. In some implementations, the heating 1010 and heating 1020 are initiated at the same time. In some implementations, the initiation times for heating 1010 and heating 1020 are delayed relative to each other. At 1011, it is determined whether the hold chamber has been heated to the first threshold temperature. At 1012, after determining 1011 that the hold chamber has been heated to the first threshold temperature, the at least one heating element is used to regulate the hold chamber at the desired regulation temperature range.

Referring to FIG. 10C, the method 1000*b* includes determining 1040 a current quantity of ink in the hold chamber of the printing system, determining 1041 if the quantity of ink exceeds an ink quantity threshold, performing 1042 the method 1000*a* of FIGS. 10A-10B if it is determined that the quantity of ink exceeds the ink quantity threshold, and causing 1043 the melt chamber to be heated if it is determined that the quantity of ink does not exceed the ink quantity threshold.

At 1040, once the printing system is powered-on but before heating the hold chamber and the print head, the quantity of ink in the hold chamber is determined using, for example, a floating sensor (such as the floating sensor 924 discussed previously with reference to FIG. 9A).

At 1041, it is determined whether the determined 1040 quantity of ink exceeds an ink quantity threshold. In some implementations, determining that the ink quantity exceeds the ink quantity threshold includes determining that the float sensor indicates at least an "ink level ok" reading, as discussed previously with reference to FIGS. 9A-9B. In some implementations, determining that the ink quantity does not exceed the ink quantity threshold includes determining that the float sensor indicates an "ink level empty" reading, as discussed previously with reference to FIGS. 9A-9B.

At 1042, after determining 1041 that the ink quantity exceeds the ink quantity threshold, the method 1000A of FIGS. 10A-10B is performed. At 1043, after determining 1041 that the ink quantity does not exceed the ink quantity threshold, the at least one heating element is used to heat the melt chamber, which causes ink in a bottle contained within the melt chamber to melt and replenish the amount of ink in the hold chamber, as discussed previously with reference to FIG. 9A. Once the hold chamber is replenished, the method 1000*a* is performed.

As used herein, a "hold chamber" includes any chamber in which ink can be held. As used herein, a "melt chamber" includes any chamber in which ink can be melted.

While this specification contains many implementation details, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Thus, unless explicitly stated otherwise, or unless the knowledge of one of ordinary skill in the art clearly indicates otherwise, any of the features of the embodiment described above can be combined with any of the other features of the embodiment described above. Thus, while particular embodiments of the invention have been described, other embodiments are within the scope of the following claims. In addition, the systems and methods described are applicable outside of printer technologies, e.g., to fluid jetting devices generally.

What is claimed is:

1. An apparatus, comprising:

a receptacle defining a hold chamber to receive ink, the receptacle comprising:

a first portion configured to hold a first quantity of ink; and a second portion that is smaller than the first portion and configured to hold a second quantity of ink, the second portion comprising:

a first heat conducting surface; and a second heat conducting surface offset from the first heat conducting surface by a distance determined in accordance with a melting point of the ink, the second heat conducting surface defining a barrier between the first portion and the second portion and including at least one opening configured to allow flow of the ink from the first portion to the second portion; and at least one heating element configured to heat the receptacle.

2. The apparatus of claim 1, wherein the at least one heating element comprises a first heating element and a second heating element.

3. The apparatus of claim 2, wherein the first heating element has a first wattage rating and the second heating element comprises a second wattage rating that is higher than the first wattage rating.

4. The apparatus of claim 1, wherein the second at least one heating element is located closer to the second portion than the first portion, and, when the heating element is heating the receptacle, the distance is sized to reduce a thermal mass of the second quantity of ink, thereby causing all of the second quantity of ink to melt before the first quantity of ink.

5. The apparatus of claim 1, further comprising a pressure relief valve coupled to the receptacle and configured to actuate when a pressure of the receptacle exceeds a threshold pressure.

6. The apparatus of claim 1, wherein the first portion comprises a first chamber and the second portions comprises a second chamber, and wherein the barrier comprises a baffle plate that separates the first chamber and the second chamber.

7. The apparatus of claim 1, wherein the at least one opening comprises a first opening located at a first end of the barrier and a second opening located at a second end of the barrier that is opposite of the first end.

8. The apparatus of claim 7, wherein the barrier comprises a plate attached to a bottom surface of the receptacle.

9. A system, comprising:

a first receptacle defining a melt chamber configured to receive a container of ink;

a second receptacle in fluidic communication with the first receptacle and defining a hold chamber configured to receive the ink from the container; the second receptacle comprising:

a first portion configured to hold a first quantity of the ink; and a second portion that is smaller than the first portion and configured to hold a second quantity of the ink, the second portion comprising:

a first heat conducting surface; and a second heat conducting surface offset from the first heat conducting surface by a distance in accordance with a melting point of the ink, the second heat conducting surface defining a barrier between the first portion and the second portion and including at least one opening configured to allow flow of the ink from the first portion to the second portion;

a first at least one heating element configured to heat the first receptacle;

a second at least one heating element configured to heat the second receptacle;

a print head comprising a plurality of nozzles and a third at least one heating element configured to heat the print head, the print head configured to eject melted ink through the plurality of nozzles;

an ink supply system comprising an ink line configured to fluidly couple the print head with the hold chamber and a fourth at least one heating element configured to heat the ink line; and control circuitry configured to:

cause the first at least one heating element to heat the first receptacle;

cause the second at least one heating element to heat the second receptacle;

cause the third at least one heating element to heat the print head; and cause the fourth at least one heating element to heat the ink line.

10. The system of claim 9, further comprising a sensor located within the first portion of the second receptacle, wherein the control circuitry is further configured to:

determine, based on information captured by the sensor, a current quantity of ink being held in the second receptacle; and cause the first at least one heating element to heat the first receptacle when the current quantity of ink does not exceed a threshold quantity.

11. The system of claim 9, wherein the control circuitry is further configured to:

cause the third at least one heating element to heat the print head to a threshold temperature;

cause the fourth at least one heating element to heat the ink line to the threshold temperature; and cause the second at least one heating element to heat the hold chamber to the threshold temperature.

12. The system of claim 11, wherein:

the second at least one heating element comprises:

a primary heating element that comprises a first wattage rating; and a secondary heating element that comprises a second wattage rating being higher than the first wattage rating; and the startup procedure comprises turning off the secondary heating element when the second receptacle is heated to the second threshold temperature.

13. The system of claim 11, wherein the startup procedure comprises causing the third at least one heating element to heat the print head to the second threshold temperature.

14. The system of claim 9, further comprising a pressure relief valve coupled to the second receptacle and configured to actuate when a pressure of the second receptacle exceeds a threshold pressure.

15. The system of claim 9, wherein the at least one opening comprises a first opening located at a first end of the barrier and a second opening located at a second end of the barrier that is opposite of the first end.

16. The system of claim 9, wherein the second at least one heating element is located closer to the second portion than the first portion and the distance is configured to cause all of the second quantity of ink to melt before the first quantity of ink, when the second at least one heating element is heating the second receptacle, by reducing a thermal mass of the second quantity of ink relative to the first quantity of ink.

17. A non-transitory computer-readable storage medium encoding instructions that cause control circuitry of a printing system to perform operations comprising:

regulating, using at least one heating element, an ink line of the printing system at a threshold temperature;

regulating, using at least one heating element, a print head of the printing system at the threshold temperature; and causing the at least one heating element to heat a hold chamber of the printing system to a second threshold temperature.

18. The non-transitory computer-readable storage medium of claim 17, wherein the operations further comprise:

determining, based on information captured by a sensor within a first portion of the hold chamber, a current quantity of ink being held in the hold chamber; and causing the at least one heating element to heat a melt chamber of the printing system when the current quantity of ink does not exceed a threshold quantity.

19. The non-transitory computer-readable storage medium of claim 18, wherein:

the at least one heating element comprises:

a primary heating element that comprises a first wattage rating; and a secondary heating element that comprises a second wattage rating being higher than the first wattage rating;

the primary heating element and the secondary heating element are used to heat the hold chamber to the second threshold temperature; and the operations further comprise turning off the secondary heating element when the hold chamber is heated to the second threshold temperature.

20. The non-transitory computer-readable storage medium of claim 17, wherein the operations further comprise causing the at least one heating element to heat the print head to the second threshold temperature.

* * * * *